US006062148A

United States Patent [19]

Hodge et al.

[11] Patent Number: 6,062,148

[45] Date of Patent: May 16, 2000

[54] HEIGHT ADJUSTABLE SUPPORT FOR COMPUTER EQUIPMENT AND THE LIKE

[75] Inventors: Andrew B. Hodge, San Francisco; Steven P. Vassallo, Palo Alto, both of Calif.; Alan M. Vale, Marblehead, Miss.; Jonathan I. Kaplan, Palo Alto, Calif.; Bradley D. Youngs, Grand Rapids, Mich.

[73] Assignee: Steelcase Development Inc., Grand Rapids, Mich.

[21] Appl. No.: 09/127,203

[22] Filed: Jul. 31, 1998

Related U.S. Application Data

[60] Provisional application No. 60/054,608, Aug. 1, 1997.

[51] Int. Cl.[7] ..... A47B 9/00

[52] U.S. Cl. ..... 108/147

[58] Field of Search ..... 100/147, 146, 100/144.11; 248/161, 162.1, 404, 157, 414

[56] References Cited

U.S. PATENT DOCUMENTS

| | | |
|---|---|---|
| 248,743 | 10/1881 | Hill . |
| D. 296,851 | 7/1988 | Kelley . |
| D. 335,787 | 5/1993 | Hollington . |
| 610,933 | 9/1898 | Wagoner . |
| 878,674 | 2/1908 | Samuelson . |
| 2,641,338 | 6/1953 | Findley . |
| 2,705,354 | 4/1955 | Parsons . |
| 3,207,099 | 9/1965 | Black et al. . |
| 3,259,081 | 7/1966 | Ståalnacke . |
| 3,285,207 | 11/1966 | Vom Hagen . |
| 3,304,892 | 2/1967 | Bengtson . |
| 3,310,136 | 3/1967 | Bricker et al. . |
| 3,347,511 | 10/1967 | Myers . |
| 3,358,620 | 12/1967 | Parigi . |
| 3,359,927 | 12/1967 | Janus . |
| 3,415,586 | 12/1968 | Hammond . |
| 3,651,899 | 3/1972 | Yoshii . |
| 3,675,597 | 7/1972 | Oddsen et al. . |
| 3,682,108 | 8/1972 | Perminov . |
| 3,707,930 | 1/1973 | Yindra et al. . |
| 3,820,752 | 6/1974 | Oram . |
| 3,890,907 | 6/1975 | Peterson . |
| 3,905,311 | 9/1975 | Carpentier . |
| 4,074,873 | 2/1978 | Hayashi et al. . |

(List continued on next page.)

FOREIGN PATENT DOCUMENTS

| | | |
|---|---|---|
| 876321 | 5/1953 | Germany . |
| 916212 | 6/1954 | Germany . |
| 8801157 | 12/1989 | United Kingdom . |
| 4023768 | 1/1992 | United Kingdom . |
| 4026675 | 1/1992 | United Kingdom . |
| 9400107 | 3/1994 | WIPO . |

*Primary Examiner*—Jose V. Chen
*Attorney, Agent, or Firm*—Price, Heneveld, Cooper, DeWitt, & Litton

[57] ABSTRACT

A counterbalance mechanism for height adjustable computer equipment supports and the like that includes a drive shaft mounted on an associated support for axial rotation. The drive shaft is operably connected with a worksurface to facilitate vertical adjustment of the same within a predetermined range. The counterbalance mechanism has a first energy storage device operably connected between the support and the drive shaft, which applies a first axial torque to the drive shaft in a first rotational direction. The first energy storage device is configured such that the first axial torque diminishes at a predetermined rate as the drive shaft rotates in the first rotational direction. A second energy storage device is operably connected between the support and the drive shaft, and applies a second axial torque to the drive shaft in a second rotational direction, opposite to the first rotational direction, thereby defining a resultant counterbalance force which facilitates vertical adjustment of the worksurface. The second energy storage device is configured such that when the drive shaft rotates in the first rotational direction, the second axial torque diminishes at a rate which is substantially equal to the predetermined rate of the first energy storage device, whereby the resultant counterbalance force remains generally constant throughout the predetermined range of vertical adjustment of the worksurface.

49 Claims, 17 Drawing Sheets

U.S. PATENT DOCUMENTS 4,130,069 12/1978 Evans et al. .
4,195,578 4/1980 Benoit et al. .
4,208,028 6/1980 Brown et al. .
4,247,068 1/1981 Edelson et al. .
4,266,747 5/1981 Souder, Jr. et al. .
4,315,466 2/1982 Boerigter .
4,373,334 2/1983 Carlander .
4,381,714 5/1983 Henneberg et al. .
4,384,742 5/1983 Wisniewski .
4,440,096 4/1984 Rice et al. .
4,515,087 5/1985 Kurrasch .
4,590,865 5/1986 Rutsche .
4,593,874 6/1986 Dunagan .
4,604,955 8/1986 Fleischer et al. .
4,615,279 10/1986 de la Haye .
4,619,208 10/1986 Kurrasch ..... 108/147
4,627,364 12/1986 Klein et al. .
4,650,143 3/1987 Kurrasch .
4,651,652 3/1987 Wyckoff ..... 108/147
4,667,605 5/1987 Bastian .
4,714,025 12/1987 Wallin et al. .
4,747,353 5/1988 Watt .
4,751,884 6/1988 Ball .
4,753,409 6/1988 Wilcox .
4,768,762 9/1988 Lund .
4,790,611 12/1988 Craner .
4,852,500 8/1989 Ryburg et al. .
4,881,471 11/1989 Schwartz et al. .
4,898,103 2/1990 Pontoppidan et al. .
4,922,836 5/1990 Damico .
4,969,403 11/1990 Schwartz et al. .
4,981,085 1/1991 Watt ..... 108/147
4,987,835 1/1991 Schwartz et al. .
5,020,752 6/1991 Rizzi et al. .
5,083,514 1/1992 Schwartz et al. .
5,088,421 2/1992 Beckstead .
5,129,611 7/1992 Grover et al. ..... 108/147 X
5,224,429 7/1993 Borgman et al. .
5,230,290 7/1993 Crossman .
5,236,171 8/1993 Holmquist .
5,243,921 9/1993 Kruse et al. .
5,244,253 9/1993 Hollington et al. .
5,259,326 11/1993 Borgman et al. .
5,282,593 2/1994 Fast .
5,289,782 3/1994 Rizzi et al. .
5,311,827 5/1994 Greene .
5,322,025 6/1994 Sherman et al. .
5,323,695 6/1994 Borgman et al. .
5,337,678 8/1994 Grout .
5,339,750 8/1994 Smies .
5,370,063 12/1994 Childers .
5,373,793 12/1994 Crossman .
5,394,809 3/1995 Feldpausch et al. .
5,398,622 3/1995 Lubinskas et al. .
5,400,721 3/1995 Greene ..... 108/147
5,402,736 4/1995 Dausch .
5,408,940 4/1995 Winchell .
5,421,481 6/1995 Fortmann et al. ..... 108/147 X
5,447,099 9/1995 Adams et al. .
5,467,721 11/1995 Gosch .
5,483,903 1/1996 Pierce et al. .
5,495,811 3/1996 Carson et al. .
5,526,756 6/1996 Watson .
5,549,052 8/1996 Hoffman .
5,549,053 8/1996 Grout .
5,598,788 2/1997 Jonker .
5,598,789 2/1997 Jonker .
5,682,825 11/1997 Manner ..... 108/147
5,706,739 1/1998 Shaheen et al. ..... 108/147
5,715,759 2/1998 Lee ..... 108/147 X
5,718,406 2/1998 Long ..... 108/147 X
5,778,799 7/1998 Eyre .
5,819,669 10/1998 Eyre ..... 108/147

HEIGHT ADJUSTABLE SUPPORT FOR COMPUTER EQUIPMENT AND THE LIKE

CROSS-REFERENCES TO RELATED APPLICATIONS

This application claims the benefit of U.S. Provisional Application Ser. No. 60/054,608, filed Aug. 1, 1997, which is hereby incorporated herein by reference.

BACKGROUND OF THE INVENTION

The present invention relates to height adjustable supports for office equipment and the like, and in particular to an adjustable height support that includes a counterbalance mechanism with a substantially constant counterbalance force.

Various types of desks and other supports have been used in office environments for office equipment, such as computers and the like. Worksurfaces may be used by different individuals for different types of tasks such that a fixed-height worksurface does not provide the desired degree of adjustability. Accordingly, adjustable height worksurfaces have been developed to provide flexibility for various applications and different user's requirements.

Some types of height adjustable worksurfaces include a manual, gear driven height adjustment arrangement that requires an operator to manually turn a crank handle for height adjustment. This type of an arrangement may require substantial physical exertion by the user. Also, because the crank handle must be turned a large number of revolutions to adjust the worksurface weight a substantial amount, this arrangement does not allow for quick adjustment of the worksurface height.

Other known height adjustable worksurfaces utilize a load compensator spring or counterbalance. This arrangement produces a lifting force biasing the worksurface into a raised position, with a releasable lock to hold the worksurface at a user-selected height. With a weight, such as a computer, resting on the worksurface, a user can release the stop, grasp the worksurface, and move the worksurface to the desired height. Ideally, the lifting force is about equal to the weight on the worksurface, such that the worksurface can be moved upwardly or downwardly without excessive effort by the user. Although some designs have an adjustable lifting force, because the user cannot easily determine what the magnitude of the lifting force is set at, it may be difficult for a user to properly adjust the lifting force to match the weight on the worksurface. If the lifting force is set improperly such that an imbalanced condition exists, excessive effort by the user may be required to move the worksurface to the desired height. In addition, if the lock is released when the worksurface is imbalanced, the worksurface may move suddenly upward or downward. Further, known height locks may not engage in a secure manner, such that the worksurface moves when additional weight is placed on the worksurface.

In addition, known load compensator spring or counterbalance devices do not normally provide a constant counterforce over the range of adjustment of the worksurface. One type of known compensator spring arrangement includes a tension spring with a flexible line connected to the spring at one end, and wrapped around a cam at the other. The cam surface is chosen to provide an approximately constant torque at a given spring preload. However, if the spring preload tension is changed to compensate for a greater or lesser weight resting on the worksurface, the lifting force will no longer be constant as the height of the worksurface is varied, but rather will increase or decrease as the worksurface is raised and lowered.

SUMMARY OF THE INVENTION

One aspect of the present invention is to provide a counterbalance mechanism for vertically adjustable worksurfaces and the like. The counterbalance mechanism includes a support that is adapted to mount the counterbalance mechanism adjacent an associated worksurface. The counterbalance mechanism also includes a drive shaft mounted on the support for axial rotation. The drive shaft is adapted for operable connection with the worksurface to facilitate vertical adjustment of the same within a predetermined range. The counterbalance mechanism further includes a first energy storage device operably connected between the support and the drive shaft, and applying a first axial torque to the drive shaft in a first rotational direction. The first energy storage device is configured such that the first axial torque diminishes at a predetermined rate as the drive shaft rotates in the first rotational direction. The counterbalance mechanism further includes a second energy storage device that is operably connected between the support and the drive shaft. The second energy storage device applies a second axial torque to the drive shaft in a second rotational direction opposite to the first rotational direction, thereby defining a resultant counterbalance force which facilitates vertical adjustment of the worksurface. The second energy storage device is configured such that when the drive shaft rotates in the first rotational direction, the second axial torque diminishes at a rate which is substantially equal to the predetermined rate of the first energy storage device, whereby the resultant counterbalance force remains generally constant throughout the predetermined range of vertical adjustment of the worksurface.

Another aspect of the present invention is a counterforce mechanism for adjustable furniture and the like that includes a support adapted to mount the counterforce mechanism in an associated furniture article. The counterforce mechanism further includes a drive shaft mounted on the support for axial rotation. The drive shaft is adapted for operable connection with the furniture article to facilitate adjustment of the same. The counterforce mechanism further includes a first energy storage device that is operably connected between the support and the drive shaft. The first energy storage device applies a first axial torque to the drive shaft in a first rotational direction. The counterforce mechanism also includes an eccentric mounted on the drive shaft and rotating therewith. A second energy storage device is operably connected between the support and the eccentric. The second energy storage device applies a second axial torque to the drive shaft in a second rotational direction opposite to the first rotational direction, thereby defining a resultant counterbalance force which facilitates adjustment of the furniture article.

Another aspect of the present invention is a height adjustable support for office equipment and the like, including a worksurface and a base shaped to support the worksurface. A guide operably connects the worksurface with the base for movement between a raised position and a lowered position. The height adjustable support further includes a drive shaft mounted in the support for axial rotation. The drive shaft is operably connected with the worksurface such that rotation of the drive shaft shifts the worksurface. The counterbalance mechanism is operably connected between the worksurface and the base. The counterbalance mechanism generates a lifting force which biases the worksurface toward the raised position. The height adjustable support further includes a brake mechanism retaining the worksurface in a select position. The brake mechanism includes a brake surface rotating with the drive shaft and a flexible line wrapped about at least a portion of the brake surface. A brake actuator shifts between a locked position wherein the flexible line is tensed and frictionally engages the brake surface to prevent rotation of the drive shaft, and an unlocked position wherein the flexible line is slackened and allows the drive shaft to rotate.

Yet another aspect of the present invention is a height adjustable support for computers and the like that includes a worksurface, a base, and a guide operably interconnecting the support surface and the base for guided motion between a raised position and a lowered position. A counterforce mechanism generates a lifting force biasing the worksurface into the raised position, and an indicator is operably connected to the counterforce mechanism and communicates the magnitude of the lifting force to a user.

Yet another aspect of the present invention is a height adjustable support for computer equipment and the like that includes a base, and a worksurface having a shaft rotatably mounted thereon. The worksurface has a pair of legs extending downwardly therefrom, and including a wheel rotatably mounted adjacent the lower end of each leg. The legs slidingly engage the base. A shaft is rotatably mounted to the worksurface, and a pair of flexible lines, each forming a loop around the shaft at an upper end, and including a resilient tension member connecting said upper ends to said base. Each flexible line also forms a loop around a wheel at a lower end, each cable being fixed to the base such that rotation of the shaft tenses a portion of each of the flexible lines and evenly raises each side of the worksurface without tipping or binding.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
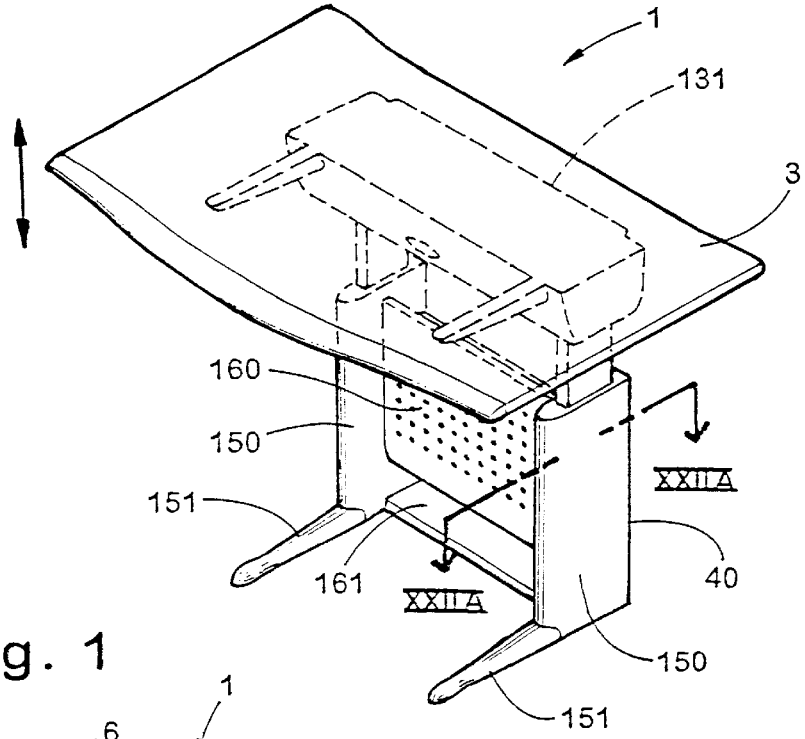
FIG. 1 is a perspective view of a height adjustable support for computer equipment and the like embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
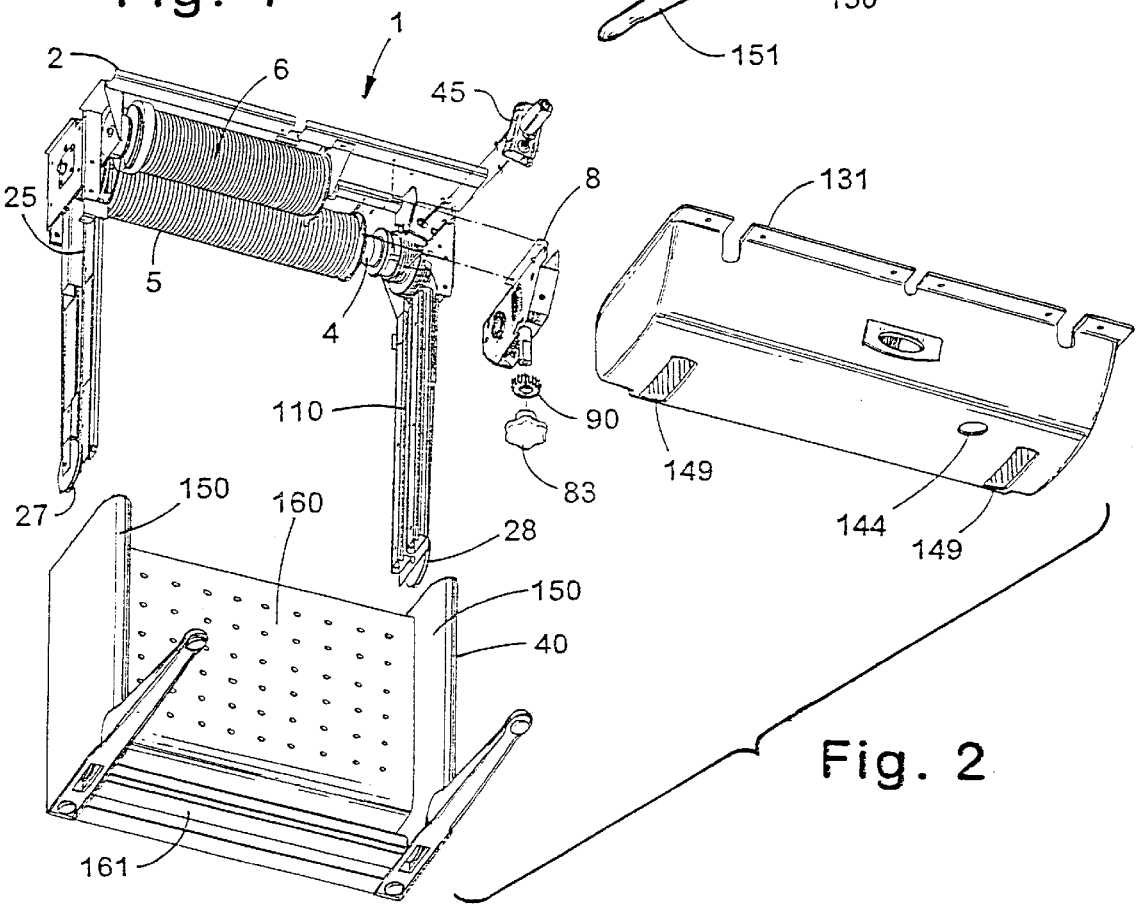
FIG. 2 is an exploded perspective view of the height adjustable support of FIG. 1 with a worksurface portion thereof removed for clarity.
Figure 3:
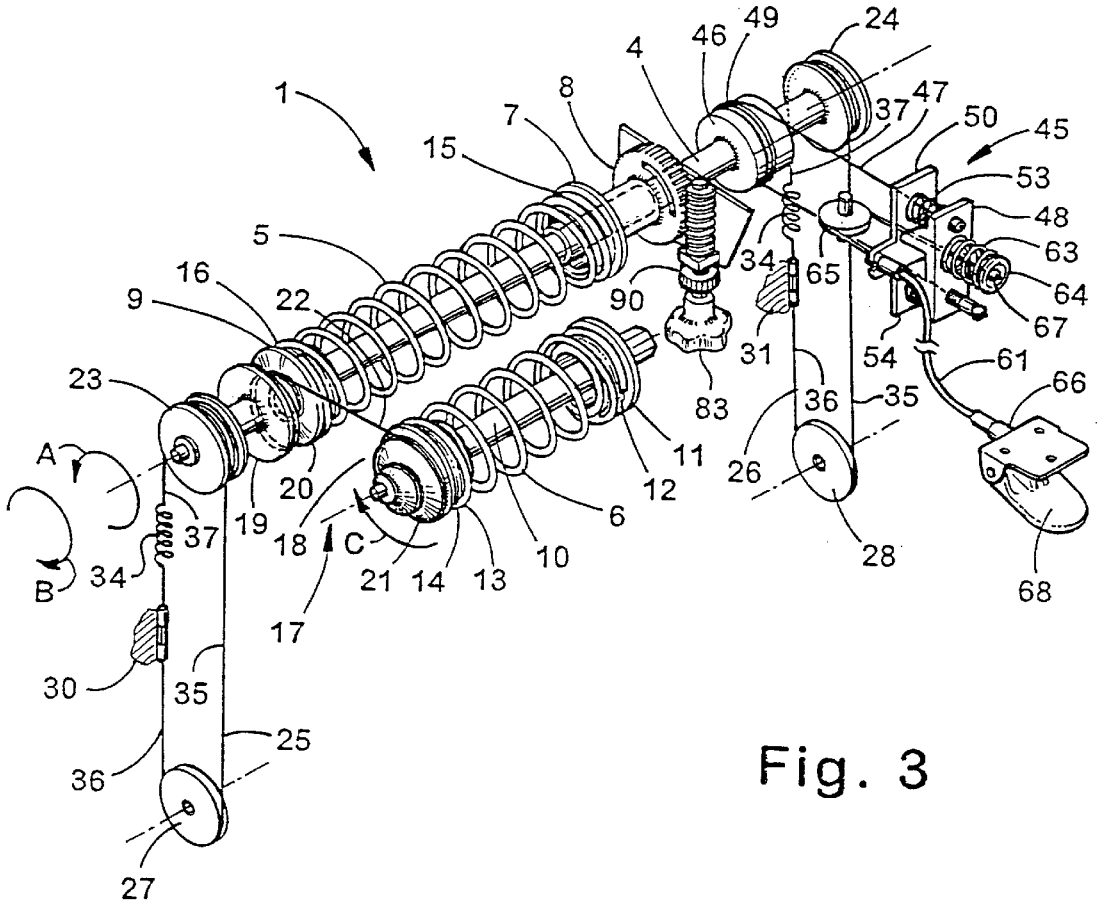
FIG. 3 is a fragmentary, perspective view of a counterbalance mechanism for the height adjustable support of FIG. 2.

The reference numeral 1 (FIG. 1) generally designates a counterbalance mechanism for vertically adjustable worksurfaces and the like embodying the present invention. In the illustrated example, the counterbalance mechanism 1 includes a support such as bracket 2 (FIG. 2) that is adapted to mount the counterbalance mechanism 1 adjacent an associated worksurface 3 (FIG. 1). With reference to FIGS. 2 and 3, a drive shaft 4 is mounted on the support 2 for axial rotation, and adapted for operable connection with the worksurface 3 to facilitate vertical adjustment of the same within a predetermined range. A first energy storage device such as a first or main spring 5 is operably connected between the support 2 and the drive shaft 4. The first energy storage device or spring 5 applies a first axial torque designated by the arrow "A" (FIG. 3) to the drive shaft 4 in a first rotational direction. The first spring 5 is configured such that the first axial torque diminishes at a predetermined rate as the drive shaft 4 rotates in the first rotational direction. A second energy storage device such as a second spring 6 is operably connected between the support 2 and the drive shaft 4, and applies a second axial torque designated by the arrow "B" (FIG. 3) to the drive shaft 4 in a second rotational direction opposite to the first rotational direction, thereby defining a resultant counterbalance force which facilitates vertical adjustment of the worksurface 3. The second energy storage device or spring 6 is configured such that when the drive shaft 4 rotates in the first rotational direction, the second axial torque diminishes at a rate which is substantially equal to the predetermined rate of the first spring 5, whereby the resultant counterbalance force remains generally constant throughout the predetermined range of vertical adjustment of the worksurface 3. In another embodiment of the present invention (not shown), the adjustable height support includes a separate keyboard support surface that is adjustably connected to the worksurface 3 for support of a computer keyboard.

In the illustrated example, the first energy storage device comprises a first, or main torsional coil spring 5 (FIG. 3) having a first end 7 that is connected to the support or bracket 2 by a rotationally adjustable mount such as preload mechanism 8. A second end 9 of the first spring 5 is fixed to the shaft 4 such that rotation of the shaft 4 causes the first spring 5 to deflect, thereby generating a torque on the drive shaft 4. Spring grounds 15 and 16 connect the first spring 5 to the preload gear mechanism 8 and the drive shaft 4, respectively. Rotation of preload mechanism 8 rotates spring ground 15 and first end 7 of first spring 5, thereby increasing or decreasing the deflection and resultant torque generated by spring 5. By adjusting the preload of first spring 5, the counterbalance torque of mechanism 1 can be adjusted to account for larger or smaller weights placed on worksurface 3, thereby providing a neutral balance condition wherein the counterbalance force is equal to the weight placed on worksurface 3. The counterforce mechanism further includes a compensator shaft 10 that is rotatably mounted to the support 2. A first end 11 of the second, or compensator spring 6 is fixably mounted to the support 2 by a spring ground 12. A second end 13 of the second spring 6 is fixed to the compensator shaft 10 by a spring ground 14. For purposes of illustration, the springs 5, 6 are shown in FIG. 3 as having a relatively "open" spiral. However, springs 5, 6 may also have a "closed" spiral as shown in FIG. 2.

Figure 5:
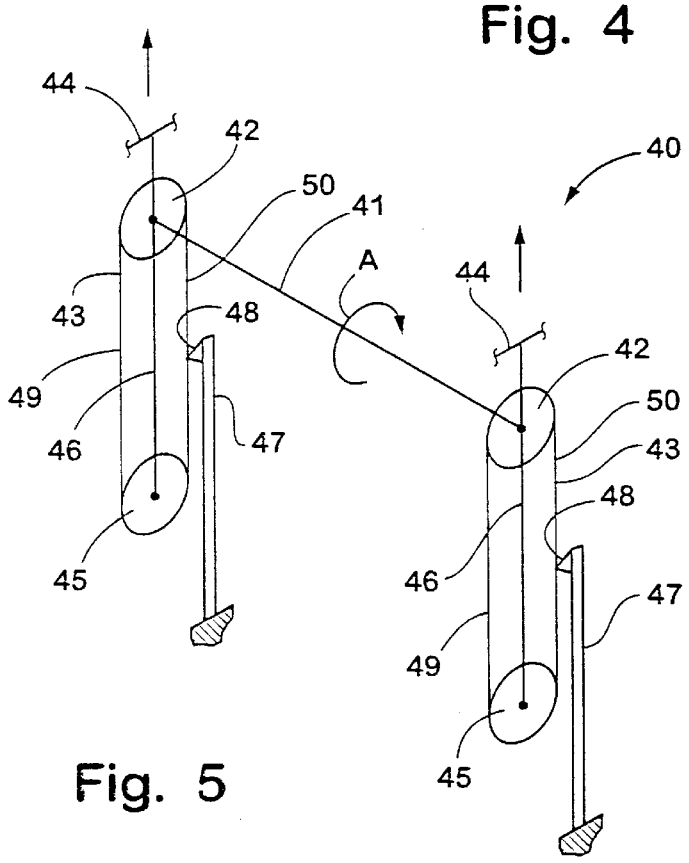
FIG. 5 is a schematic perspective view of a leg assembly for the height adjustable support of FIG. 2 showing a cable, pulley and shaft arrangement.

In the illustrated embodiment (FIG. 3), the second spring 6 is operably connected to the first spring 5 and drive shaft 4 by an eccentric such as cam 17 that includes first and second eccentrics such as cam members 18 and 19, respectively. The first and second cam members 18, 19 define spiral cam surfaces 20, 21. A cable 22 is wrapped around the spiral cam surfaces 20 and 21. Cable 22 is generally in tension and generates a torque on the drive shaft 4 in the direction of the arrow "B" resulting from the torque "C" generated by the second spring 6. Although the preferred embodiment utilizes a pair of eccentrics to vary the torque acting on drive shaft 4 due to second spring 6, other arrangements including single eccentric arrangements or single cam arrangements, could be utilized. With further reference to FIG. 5, drive pulleys 23 and 24 are fixed to the ends of the drive shaft 4. As described in detail below, first and second linear slides, or bearings 112, 113 (not shown in FIG. 5) slidably interconnect leg assemblies 110 to the base 40 for vertical movement. A lift cable 25 is wrapped around drive pulley 23 several times. The portion of lift cable 25 that is wrapped around drive pulley 23 is in tension, such that the friction between the lift cable 25 and the drive pulley 23 due to tension in cable 25 prevents slipping therebetween. A lift cable 26 is wrapped around the drive pulley 24 in a similar manner. The lift cable 25 is wound around, and supported by a lower pulley 27 that is rotationally mounted to the lower end of a leg 110. A lift cable 26 is similarly supported by a lower pulley 28 which is rotationally mounted to the other leg 110. Lift cable 25 is connected to a base 40 at an attachment point such as cable attachment bracket 30 such that rotation of the drive pulley 23 causes the support or bracket 2 and worksurface 3 to translate upwardly or downwardly, depending on the direction of rotation of the drive shaft 4 and pulleys 23 and 24. Torque "A" produces tension in portions 35 and 36 of cables 25, 26 tending to lift worksurface 3. However, the upper portion 37 of cables 25, 26 is relatively slack. A resilient tension member such as tension spring 34 in portion 37 of cables 25, 26 provides automatic length adjustment of cables 25, 26 to facilitate assembly and account for dimensional variations of the cables 25, 26 and other parts due to production tolerances. Spring 34 also provides sufficient tension to retain cables 25, 26 on drive pulleys 23, 24, respectively. Furthermore, if the worksurface 3 is lifted, thereby lifting the base 40 off the floor surface, as when moving the adjustable height support unit, upper cable portion 37 is tensed, thereby retaining base 40 to worksurface 3.

As discussed in detail below, spiral cam surfaces 20 and 21 of the first and second cam members 18 and 19, in combination with the first and second springs 5 and 6, provide a total lifting force that is constant regardless of the height of the worksurface 3. Prior cam and spring counterforce mechanisms having a single spring and cam have been utilized in an attempt to provide a relatively constant lifting force regardless of the height of the support surface. However, a single spring and cam system is generally only capable of providing a constant force for a single preload condition. Accordingly, if the spring preload is increased or decreased, the lifting force generated by the spring in a single spring system will no longer be constant at various support surface heights. In contrast, the present invention utilizes a "negative K" compensator spring 6 such that a constant lifting force across the range of motion of the worksurface is maintained even if the preload on the first spring 5 is increased or decreased to compensate for different external loads acting on the worksurface 3.

Figure 4:
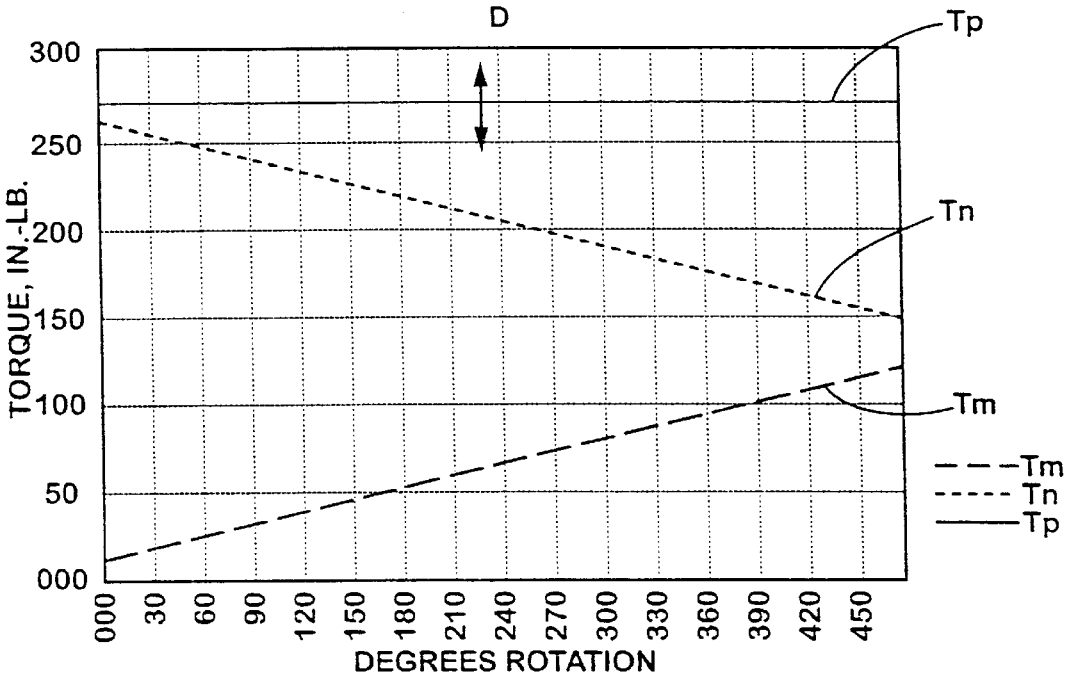
FIG. 4 is a graph of the first and second torques and the resultant counterbalance torque of the counterbalance mechanism of FIG. 2.

As illustrated in FIG. 4, the sum of the torque generated by the first spring 5 ($T_n$), and the torque generated by the second spring 6 ($T_m$) equals the total torque ($T_p$) generated by the counterbalance mechanism. The total torque ($T_p$) remains constant regardless of the degrees of rotation of the drive shaft 4. The preload mechanism 8 may be adjusted to increase the preload torque of the first spring 5. Increasing or decreasing the preload torque of the first spring 5 shifts the line ($T_n$) upwardly, or downwardly, respectively, thereby causing the total torque ($T_p$) to increase or decrease, as indicated by the arrow "D". Despite changes in the preload torque of the first spring 5, the line corresponding to the total torque ($T_p$) in the graph of FIG. 4 will remain at a zero slope, such that the total torque generated by the lift mechanism ($T_p$) remains constant regardless of the degrees of rotation (horizontal axis of the graph of FIG. 4) of the drive shaft 4.

Figure 6:
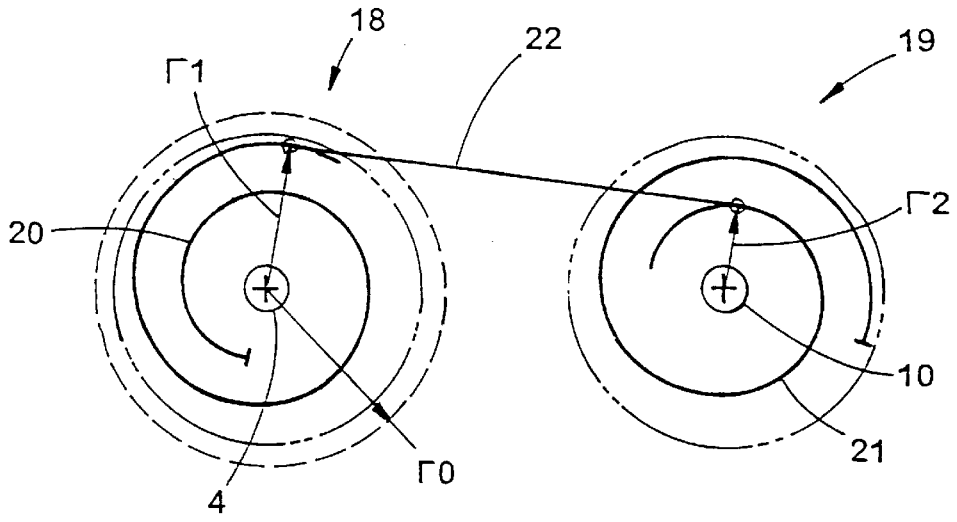
FIG. 6 is a schematic view of main cam and compensator cam portions of the counterbalance mechanism of FIG. 2.
Figure 7:
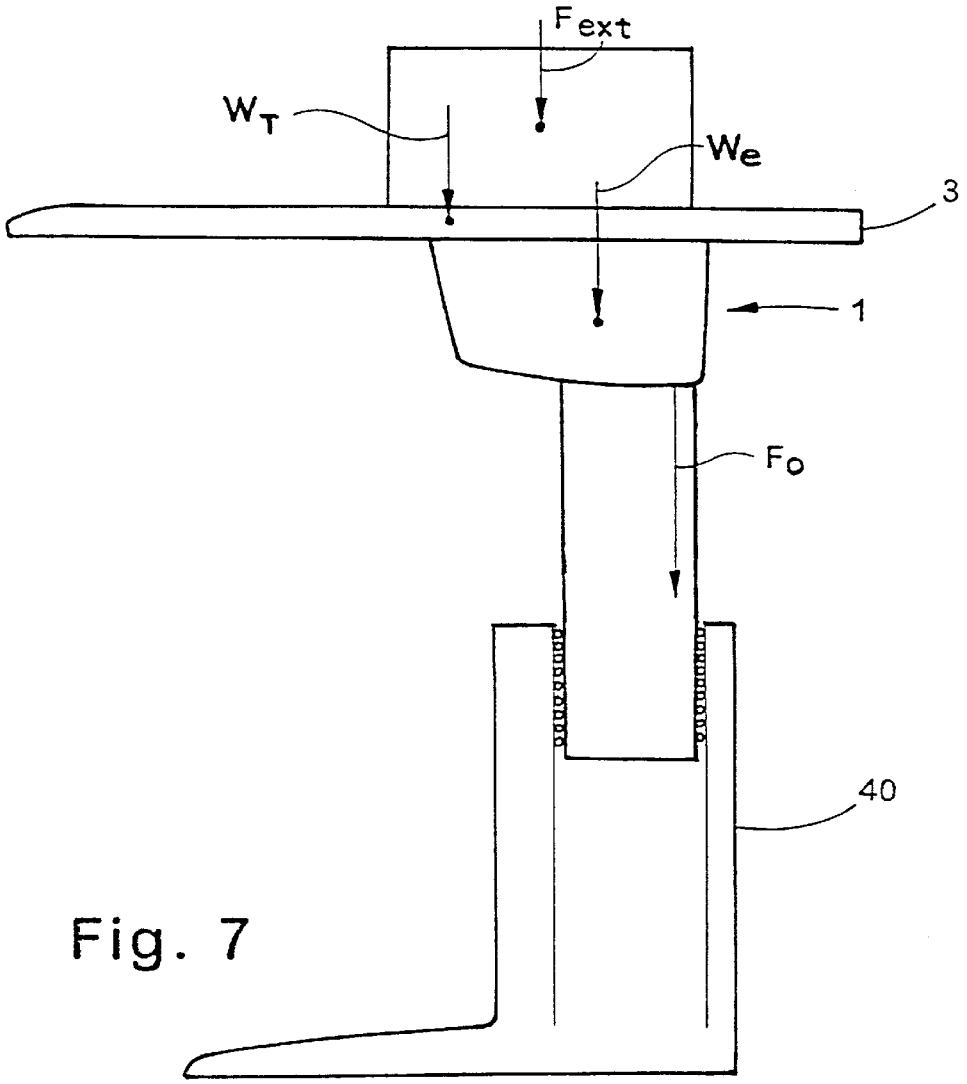
FIG. 7 is a schematic side elevational view of the leg assembly, showing the forces acting on the support.

The spiral cam surfaces 20 and 21 are shown schematically in FIG. 6. The spiral cam surfaces 20 and 21 are configured such that the total torque generated by the counterbalance mechanism remains constant, regardless of the rotational angle of the drive shaft 4 or the preload torque of the first spring 5. To solve for the proper configuration of the cam surfaces 20 and 21, the variables may be defined as follows:

$F_0$=output force required on the lift cable to support the load $F_c$=tension force in cam cable $r_1$=effective radius of main cam $r_2$=effective radius of compensator cam $r_0$=radius of drive pulley $T_m$=first spring torque $k_m$=first spring rate $\theta_m$=first spring angular displacement $T_c$=second spring torque $k_c$=second spring rate $\theta_c$=second spring angular displacement $l_m$=effective length of cable on first cam $1_c$=effective length of cable on second cam $\Delta l_m$=change in cable length on first cam per increment of angular rotation $\Delta l_c$=change in cable length on second cam per increment of angular rotation With reference to FIG. 7, the following equation describes the force balance:

$$F_0=F_{ext}+W_T+W_e+f$$

Where:

$F_{ext}$=external load applied to the worksurface $W_T$=weight of worksurface $W_e$=weight of counterbalance mechanism f=total friction of telescoping leg members Where:

$$T_m=k_m\theta_m.$$

$$T_c=k_c\theta_c$$

Therefore, at any angular rotation of the drive pulley:

$$F_0r_0=T_m+r_1/r_2\ T_c$$

$$T_m=k_m\theta_m$$

$$T_c=k_c\theta_c$$

And:

$$\Delta l_m=\Delta l_c$$

$$l_m=_r_1d\theta_m$$

$$l_c=_r_2d\theta_c$$

Where:

$$r_1=f(\theta_m)$$

$$r_2=f(\theta_c)$$

Therefore, $r_1$ and $r_2$ are functions of $\theta_m$ and $\theta_c$, respectively, and the function $f(\theta)$ for either the main or the compensator cams may be chosen and the other cam radius calculated according to the equations listed above. If a single eccentric, or cam arrangement is desired, $f(\theta)$ for either the main cam or the compensator cam is set at a constant value, and the other radius is calculated.

Figure 8:
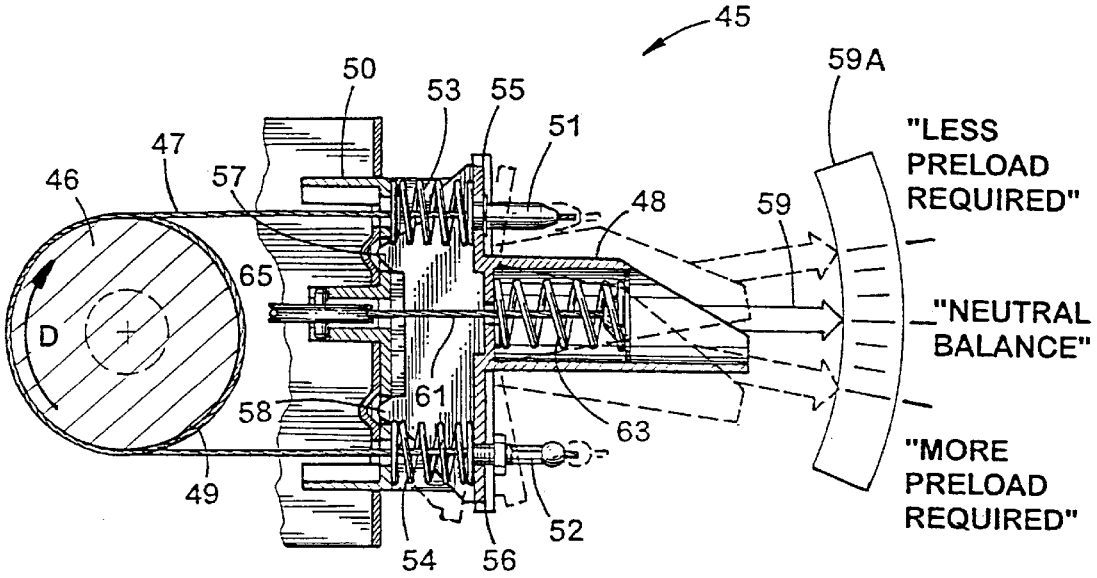
FIG. 8 is a cross-sectional view of a brake mechanism portion of the height adjustable support.
Figure 9:
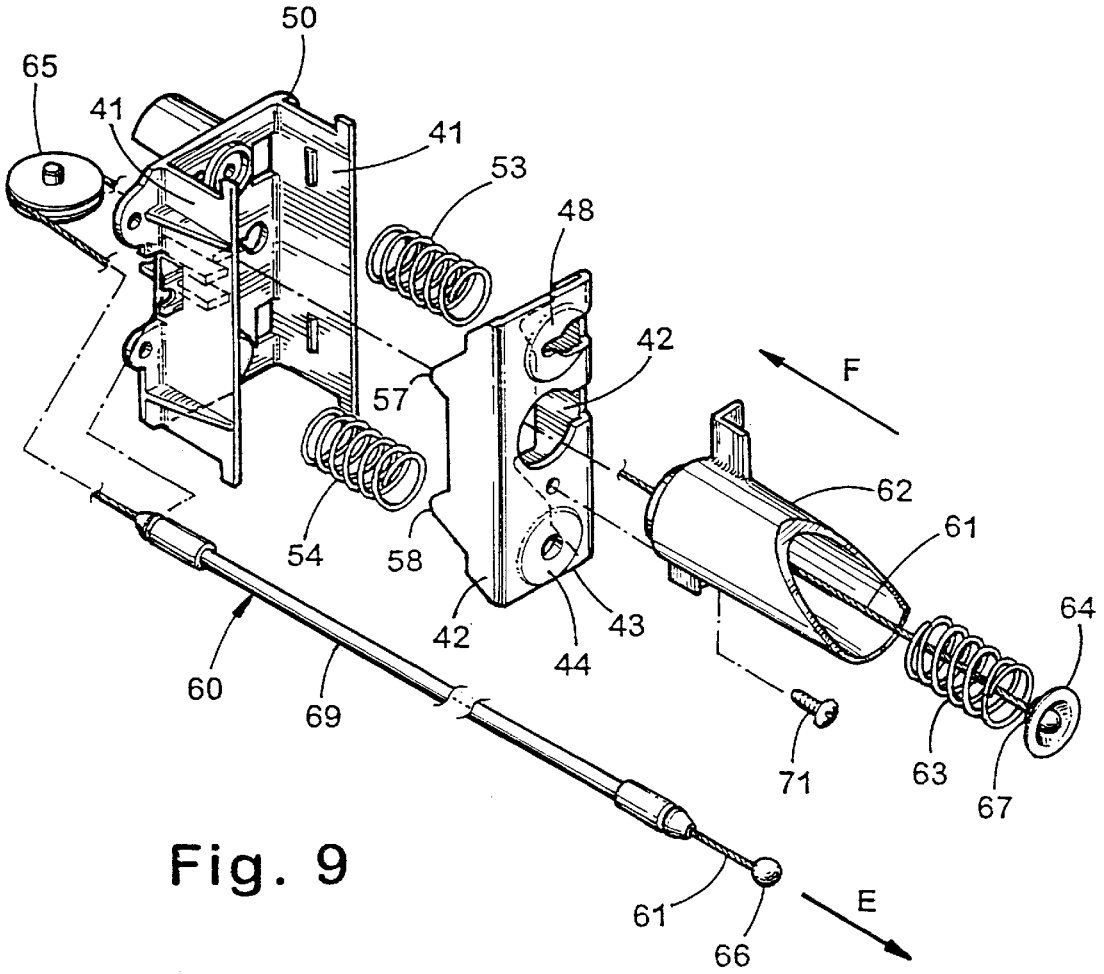
FIG. 9 is an exploded, perspective view of the brake mechanism.
Figure 10:
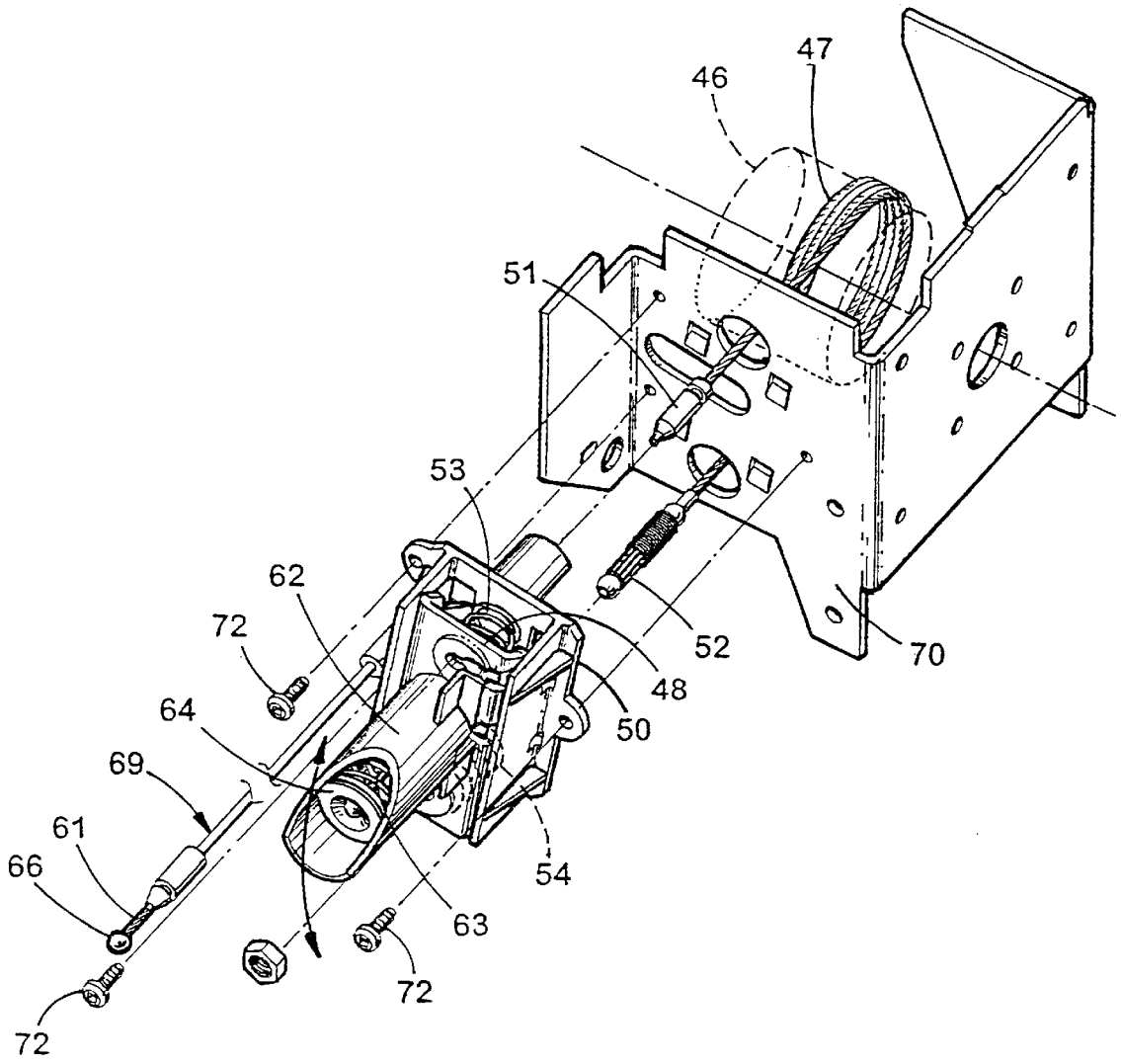
FIG. 10 is another exploded, perspective view of the brake mechanism.

With reference to FIGS. 8–10, a brake mechanism 45 rotationally locks the drive shaft 4 to secure the worksurface 3 at a user-selected height. A brake drum 46 is fixed to the drive shaft 4. A brake cable 47 includes several loops 49 around the brake drum 46 that frictionally engage the brake drum 46 when tension is applied to the brake cable 47. A first end 51 of the brake cable 47 is connected to an upper portion 55 of a brake plate 48, and a second end 52 of the brake cable 47 is connected to a lower portion 56 of a brake plate 48. A pair of brake springs 53 and 54 bias the brake plate 48 away from a base plate 50, and tense the brake cable 47, thereby locking the drive shaft 4 and preventing vertical movement of the worksurface 3. When a torque "D" is applied to the brake drum 46, the lower brake spring 54 is compressed, and the upper brake spring 53 extends, rotating the brake plate 48 in a clockwise manner as illustrated in FIG. 8. If a torque opposite arrow "D" is applied to the brake drum 46, the brake plate 48 will rotate upwardly in a counterclockwise direction.

The rotational position of brake plate 48 provides a visual indication of an unbalanced condition caused by having too much or too little counterforce for the weight on the worksurface 3. A torque D occurs when the counterbalance torque generated by the first and second springs 5, 6 is either too large or too small relative to the weight on worksurface 3 such that an unbalanced condition exists. As best seen in FIGS. 3 and 5, a weight on worksurface 3 places portions 35 and 36 of lift cables 25 and 26 in tension, generating a torque on drive shaft 4 that is counteracted by the counterbalance force or torque generated by springs 5 and 6, as discussed above. Torque D is equal to the difference between the counterbalance torque and the "external" torque resulting from a weight on worksurface 3.

Torque D will act in a counterclockwise direction (FIG. 8) when the counterbalance torque is greater than the "external" torque, shifting brake 48 in a counterclockwise direction. Similarly, torque D will act in a clockwise direction when the external torque is greater than the counterbalance torque, shifting brake plate 48 in a clockwise direction. An arrow or other indicator 59 can be connected to brake plate 48, such that the indicator 59 moves when plate 48 moves. A dial or other readout 59A is fixed to a nonmoving part, such as support 2, or cover 131. Indicator 59 thereby provides a visual indication of an unbalanced condition, and also indicates whether more or less preload on first spring 5 is required to achieve a neutral balance. The magnitude of the rotation of brake plate 48 and indicator 59 corresponds to the magnitude of the imbalance torque D, such that readout 59A can include indicia corresponding to the magnitude of the imbalance. Furthermore, readout 59A may have indicia of the range corresponding to the predetermined range of allowable imbalance described below.

To achieve a neutral balance condition, a user can grasp and rotate knob 83 of preload mechanism 8 while watching indicator 59. Rotation of knob 83 will change the counterbalance torque, thereby changing torque D resulting from an imbalance, and moving indicator 59. This arrangement facilitates quick adjustment to a neutral balance condition. Various linkage arrangements could be utilized to convert the movement of brake plate 48 into a visual indication of the balance/imbalance condition utilizing this principle. As described in detail below, another type of indicator 130 may also be used, either by itself or with indicator 59. Unlike indicator 59, indicator 130 provides a visual readout of the counterbalance torque only, and does not indicate when an imbalance exists. The brake plate 48 includes stops 57 and 58 that contact the base plate 50 upon rotation of the brake plate 48. The stops 57 and 58 limit the rotation of the brake plate 48 upon application of torque "D" to the brake drum 46. Brake springs 53, 54 maintain tension in the brake cable 47, rotationally locking shaft 4 such that worksurface 3 is locked at the selected height.

To adjust the height of worksurface 3, a release mechanism 60 (FIG. 9) shifts the brake plate 48 to a released position in the direction of the arrow "F", thereby overcoming the bias of brake springs 53 and 54, and slackening the brake cable 47. When brake cable 47 is slackened, brake drum 46 and drive shaft 4 are free to rotate for height adjustment. A release cable 61 wraps around a release pulley 65, and has a first end 66 is connected to a release lever 68 (see also FIG. 3) that is mounted to the underside of the worksurface 3. Actuation of the release lever 68 causes the first end 66 of the release cable 61 to move in the direction of the arrow "E", and moves a second end 67 of the release cable 61 in the direction of arrow "F" (FIG. 9). The second end 67 of the release cable 61 is connected to a spring retainer 64 such that the release cable 61 compresses a release spring 63 upon actuation of the release lever 68. The stiffness, or "K," of the release spring 63 is sufficiently large that the force generated by the compression of the release spring 63 will overcome the force, or bias on the brake plate 48 caused by the springs 53 and 54, but only when the brake plate 48 is in the center position. As discussed above, the brake plate 48 will remain in the center position unless a torque D (caused by an unbalanced condition) is applied to the brake drum 46. However, if the brake plate is in a rotated position due to a torque D on the brake drum 46, the force generated by the compression of the release spring 63 will be insufficient to overcome the bias generated by the brake springs 53 and 54, such that the brake cannot be released when a torque D is applied to the brake drum 46. This arrangement prevents release of the brake mechanism 45 if the external forces acting on the counterbalance mechanism are not equal to, or, are not within a predetermined range of the counterbalance force generated by the counterbalance mechanism.

The stiffness of the brake springs 53, 54 and of the release spring 63 can be chosen to allow the release mechanism 60 to release the brake only if the magnitude of the torque D acting on the drum is within a predetermined allowable range. For example, if the preload on the first spring 5 is set at a level providing a neutral balance with a 50-lb. external load on the worksurface 3, the stiffness for the springs 53, 54 and 63 may be chosen such that the brake is only released if the external force is within plus or minus 5 lbs. of the neutral balance. In this example, if the external force acting on the worksurface is less than 45 lbs., or greater than 55 lbs. (i.e., outside the predetermined allowable range), the brake plate 48 will be in a rotated position, and the force generated by the release spring 63 will be insufficient to overcome the forces generated by the brake springs 53 and 54. Accordingly, the release mechanism 60 will not allow release of the brake mechanism 45 when too large an imbalance exists between the total force generated by the lift mechanism and the weight acting on the worksurface, thereby preventing the worksurface from sudden upward or downward travel upon release of the brake. The stiffness of the brake springs 53, 54 and the release spring 63 can also be chosen to provide a larger or smaller range of allowable differences between the counterbalance torque and the torque on shaft 4 due to external forces on worksurface 3.

Brake plate 48 includes a spring guide or tube 62 that is attached to a base portion 44 of brake plate 48 by a screw 71. The base portion 44 is formed from sheet metal and has a generally U-shaped cross section defining sidewalls 42 and a web 43. Base plate 50 also has a U-shaped cross section defining sidewalls 41 that are generally parallel, and spaced-apart. The sidewalls 42 of the brake plate 48 fit between the sidewalls 41 of base plate 50 to guide brake plate 48. As illustrated in FIG. 10, the base plate 50 is attached to a bracket 70 by screws 72. The bracket 70 may form a part of the support 2 of the counterbalance mechanism 1.

Figure 11:
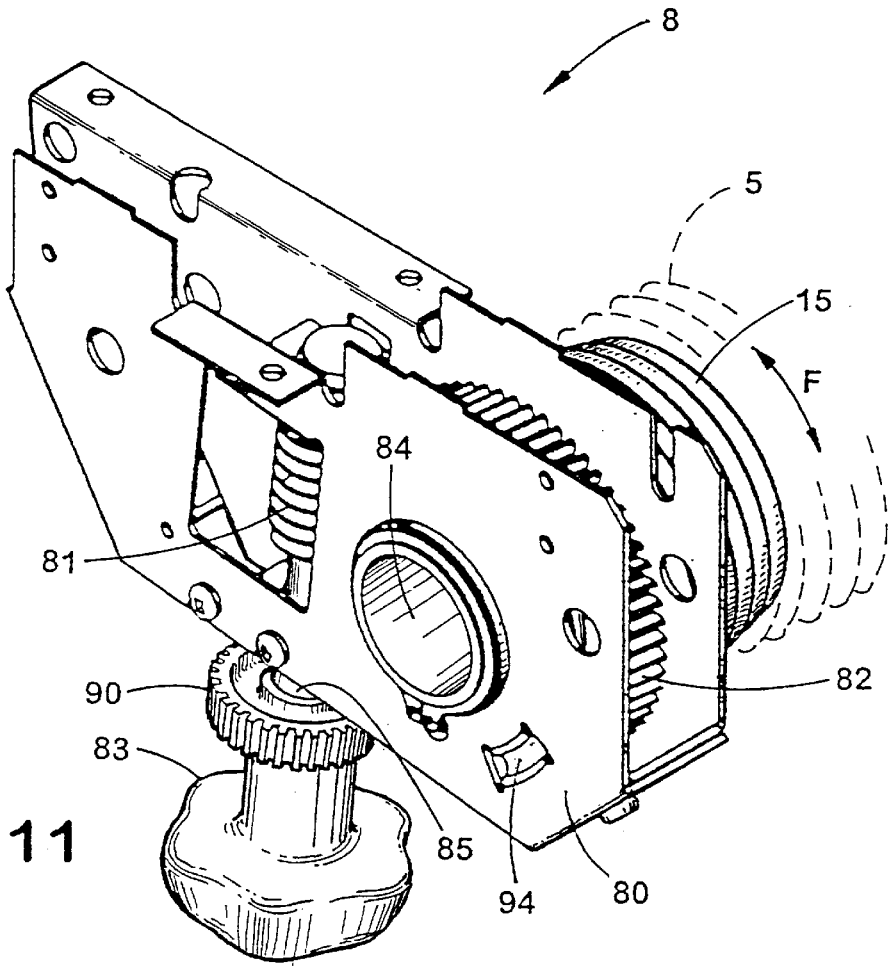
FIG. 11 is a perspective view of a main spring preload adjustment portion of the height adjustable support.
Figure 12:
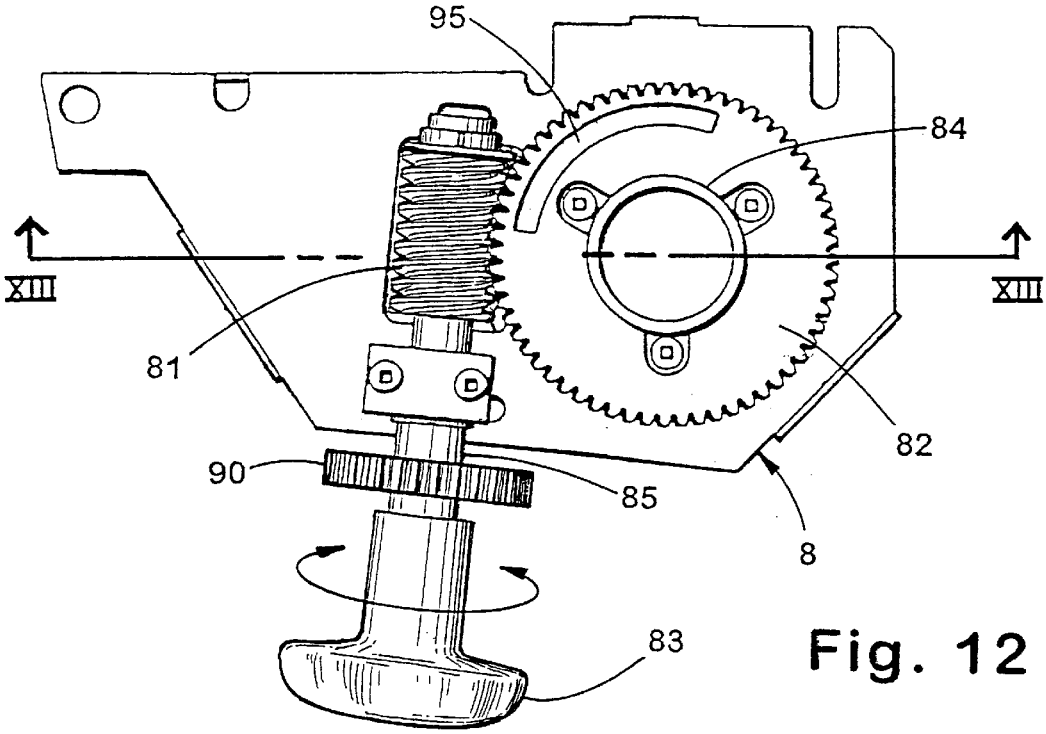
FIG. 12 is a front elevational view of the main spring preload adjustment mechanism, with the side plate removed.
Figure 13:
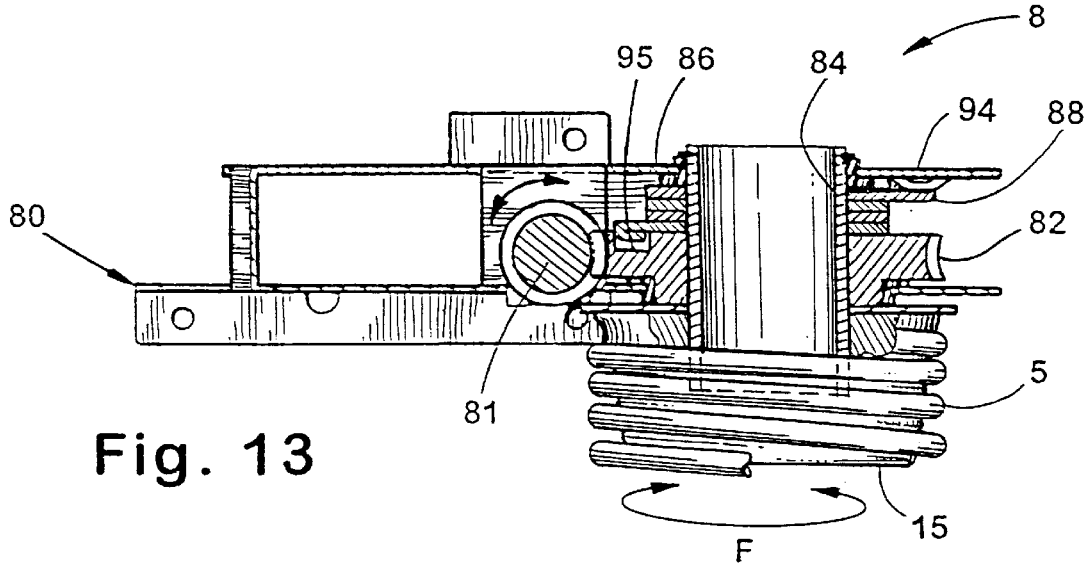
FIG. 13 is a cross-sectional view of the main spring preload adjustment mechanism, taken along the line XII—XII of FIG. 12.

The preload mechanism 8 (FIG. 11) includes a housing 80 which rotationally supports a worm gear 81 and a helical gear 82 in a meshing relationship. The helical gear 82 and spring ground 52 are each fixed to a hollow shaft 84, such that rotation of a preload knob 83 causes the spring ground 15 to rotate in the direction of the arrow "F". Rotation of the spring ground 15 increases or decreases the angular deflection of the first spring 5, thereby varying the preload torque of the first spring 5. This allows adjustment of the counterbalance torque of the counterbalance mechanism 1 to compensate for different weights placed on the worksurface 3 to achieve a neutral balance. When set at a neutral balance, a user can release the brake mechanism 45, grasp the worksurface 3, and manually "float" the worksurface 3 to the desired height with minimal effort. As described in more detail below, an indicator gear 90 is fixed to a worm gear shaft 85. Indicator gear 90 drives a preload indicator mechanism 130 that provides a visual readout of the amount of weight on worksurface 3 that will provide a neutral balance due to the counterbalance force generated by the counterbalance mechanism 1.

Figure 14:
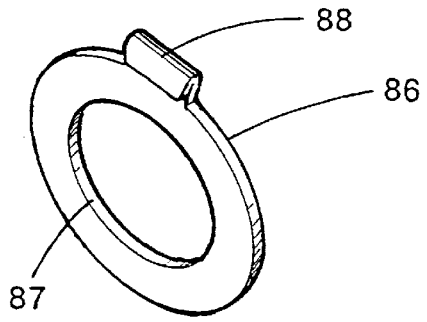
FIG. 14 is a perspective view of a limiter ring portion of the main spring preload adjustment mechanism.
Figure 15:
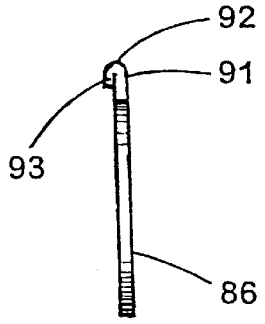
FIG. 15 is a side elevational view of the limiter ring.

The preload mechanism 8 includes several limiter rings 86 that limit the allowable number of revolutions of the spring ground 15 during preload adjustment. The limiter arrangement prevents adjustment of the preload torque to an excessively high level. With reference to FIGS. 14 and 15, the annular inner surface 87 of the ring rotatably supports the limiter ring 86 on the shaft 84. Each limiter ring 86 is made from sheet metal and includes an offset tab 88 formed by bending an extension 91 at 92 to form an offset portion 93. A plurality of limiter rings 86 fit closely together on shaft 84, such that the offset portion 93 of a first limiter ring 86 contacts the base portion 91 of the tab 88 of the adjacent limiter ring 86. The outer limiter ring 86 is adjacent the housing 80 with offset portion 93 engaging an opening 94 in the housing 80. Offset portion 93 of tab 88 of the inner limiter ring 86 adjacent the helical gear 82 engages a slot 95 in the helical gear 82. When helical gear 82 is rotated, offset portion 93 of tab 88 of the inner limiter ring 86 engages slot 95 in helical gear 82, causing the limiter ring 86 to rotate. As the limiter rings 86 rotate, the offset portion 93 of tab 88 of each limiter ring 86 contacts the extension 91 of the adjacent limiter ring 86, causing rotation thereof. After a predetermined number of revolutions or partial revolutions of the shaft 84, all of the offset portions 93 are in contact with the adjacent tab 88, and the ring 86 engaging opening 94 in housing 80 prevents further rotation. The total number of revolutions of the helical gear 82 is thereby limited to prevent excessive preload of the counterbalance mechanism.

Figure 16:
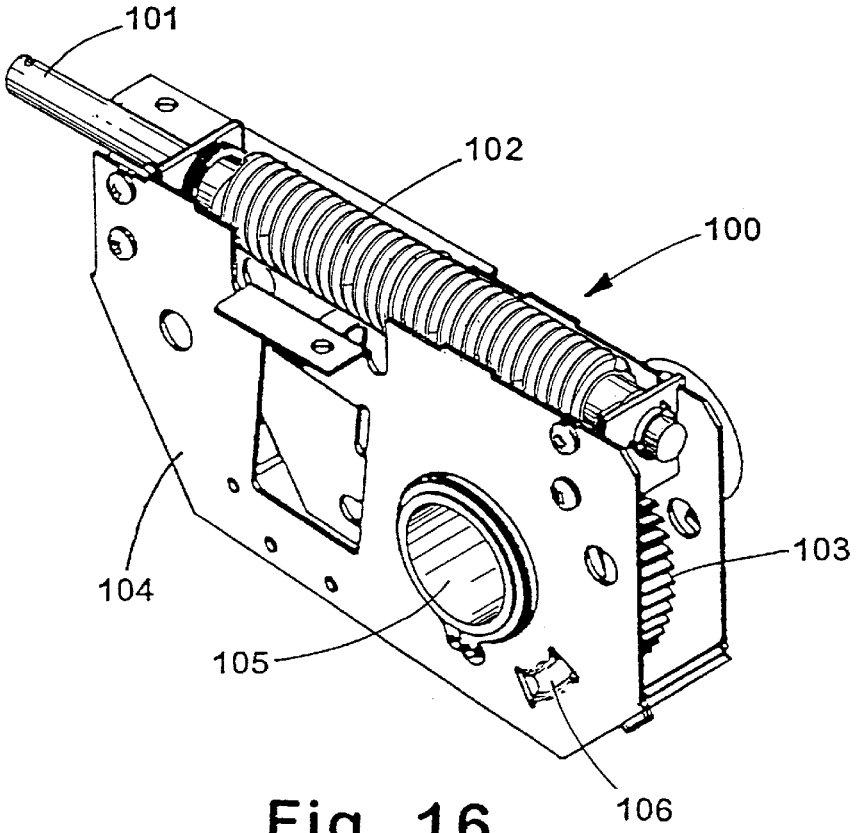
FIG. 16 is a perspective view of an alternate height-adjustment gearbox for use in the height adjustable support.
Figure 17:
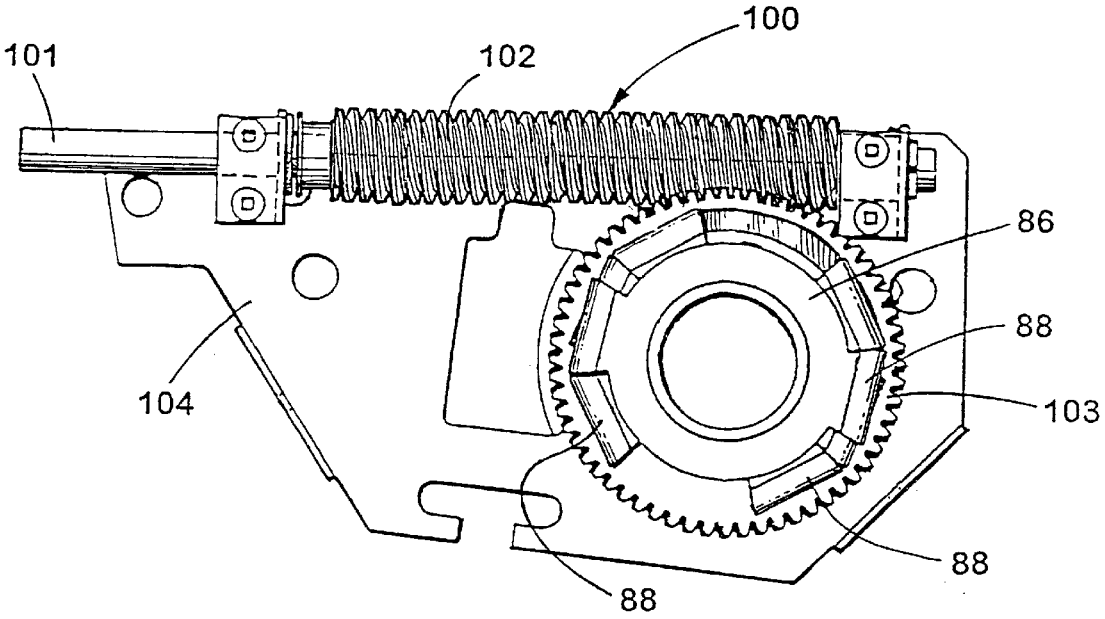
FIG. 17 is a front elevational view of the height-adjustment gearbox of FIG. 16, shown with a side plate removed.
Figure 18:
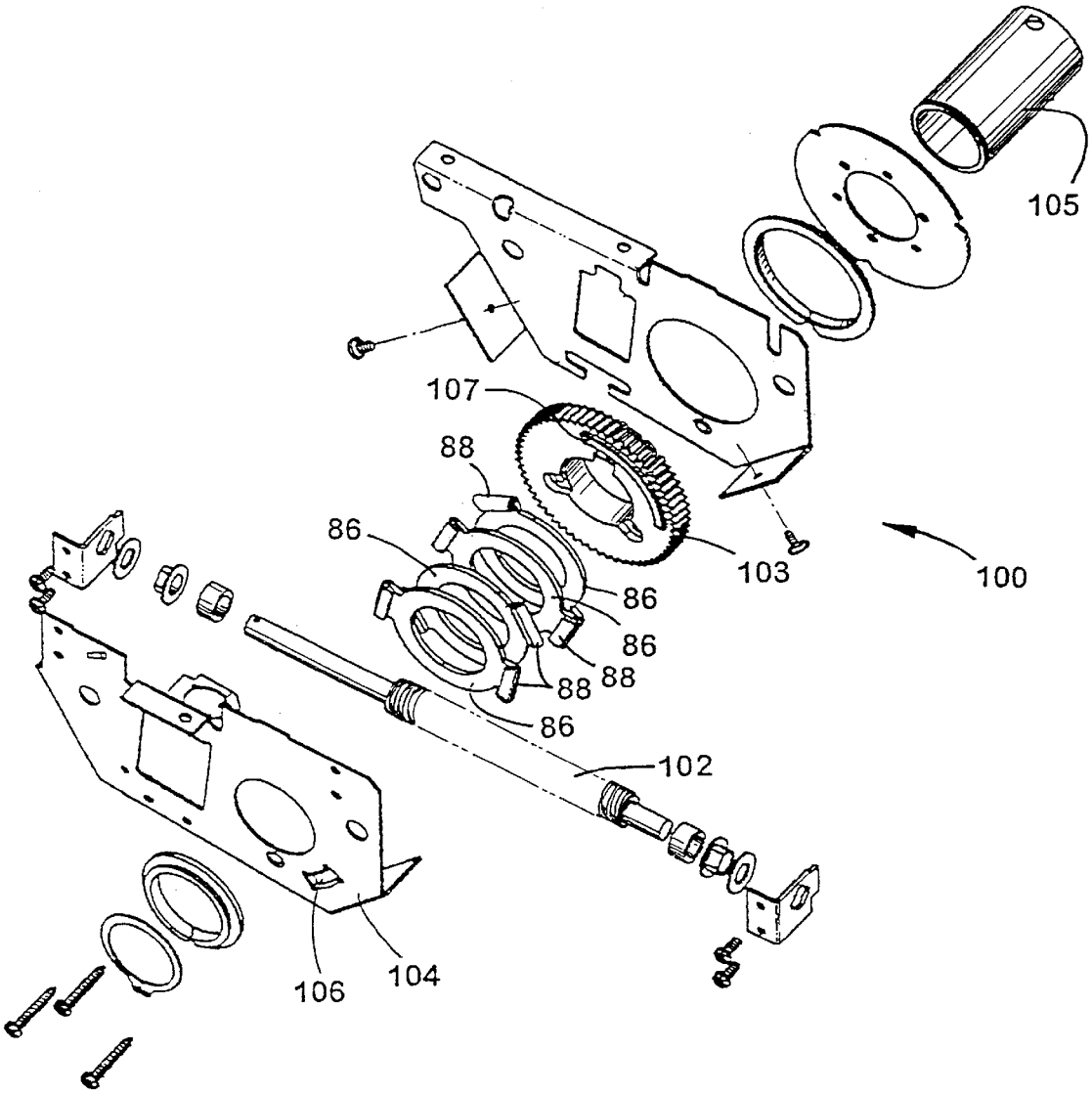
FIG. 18 is an exploded perspective view of the height-adjustment gearbox of FIG. 16.
Figure 19:
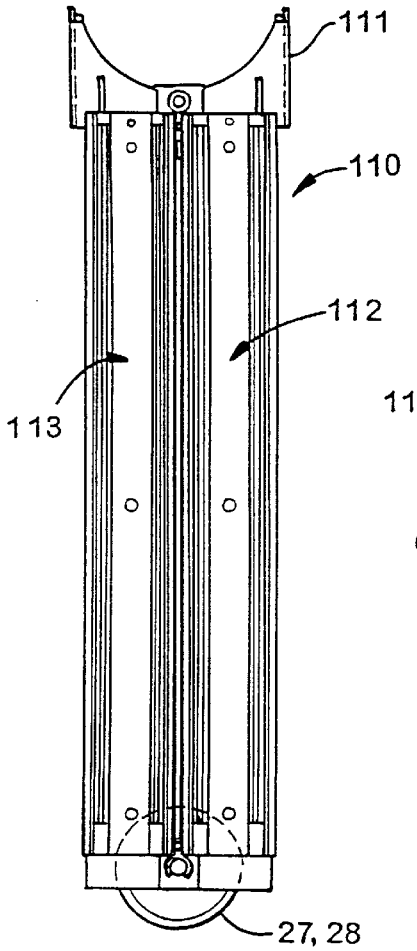
FIG. 19 is a front elevational view of the leg assembly.
Figure 20:
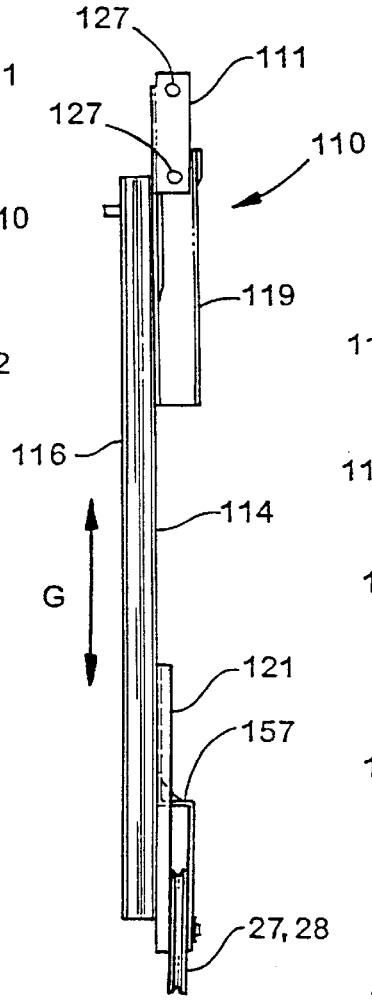
FIG. 20 is a side elevational view of the leg assembly.
Figure 21:
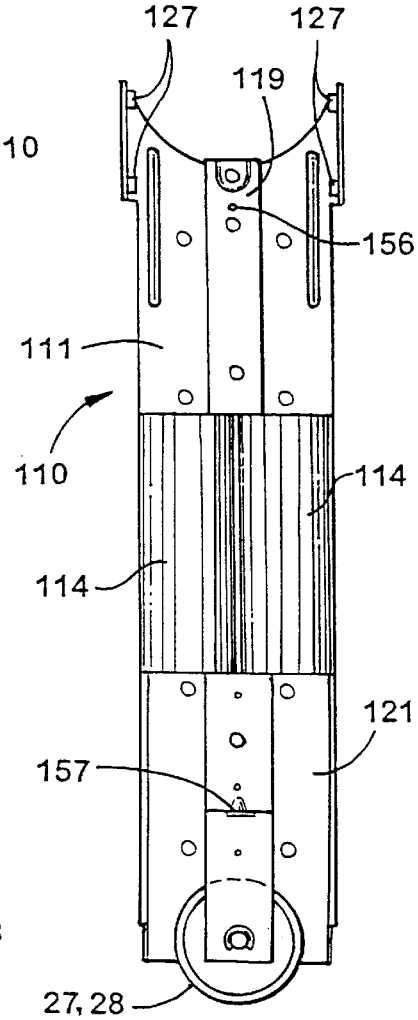
FIG. 21 is a rear elevational view of the leg assembly.

An alternate manual height-adjustment gearbox 100 is illustrated in FIGS. 16–18. The manual gearbox 100 can be used in place of the counterbalance mechanism and brake mechanism 45 described above. Gearbox 100 is configured to be substantially interchangeable with the counterforce mechanism 1, such that a substantially similar lift cable and pulley arrangement (FIG. 5) may be utilized for both embodiments of the height adjustable support. However, drive pulleys 23 and 24 may have a larger diameter when gearbox 100 is used because less mechanical advantage is required for the gearbox configuration. An input shaft 101 is rotatably mounted in a housing 104 (FIGS. 16–18). A worm gear 102 is fixed to the input shaft 101, and meshes with a helical gear 103. The helical gear 103 is fixed to a hollow shaft 105. The hollow shaft 105 is fixed to the drive shaft 4, such that rotation of the input shaft 101 raises and lowers the worksurface 3. A series of limiter rings 86 engage an opening 106 in the housing 104, and a slot 107 in the helical gear 103 to limit the number of revolutions of manual gearbox 100 in a substantially similar manner as described above with respect to the preload mechanism 8. The limiter arrangement limits the vertical travel of the worksurface 3 to a predetermined allowable range.

With reference to FIGS. 19–23, each leg assembly 110 includes an upper bracket 111 with threaded nut connectors 127 that secure bracket 111 to the bracket or support 2 of the counterbalance mechanism 1. Each leg assembly further includes first and second linear slides 112 and 113 that slidably connect the worksurface 3 to uprights 150 of base 40. Each slide includes an inner rail 114 that is fixed to upper bracket 111 and lower bracket 121 of leg assembly 110, thereby rigidly interconnecting brackets 111 and 121, and forming a rigid assembly. An outer rail 116 is fixed to uprights 150 of base 40 and slidably translates in the direction of arrow "G" (FIG. 20) relative to inner rail 114 and brackets 111 and 121 during raising and lowering of worksurface 3. An intermediate rail 115 and inner and outer ball bearings 117, 118 slidably interconnect the inner and outer rails 114, 116. A channel portion 119 of bracket 111 provides additional strength. Lower bracket 121 rotatably mounts the lower pulley 27 or 28 adjacent the lower end of leg assembly 110.

Figure 23:
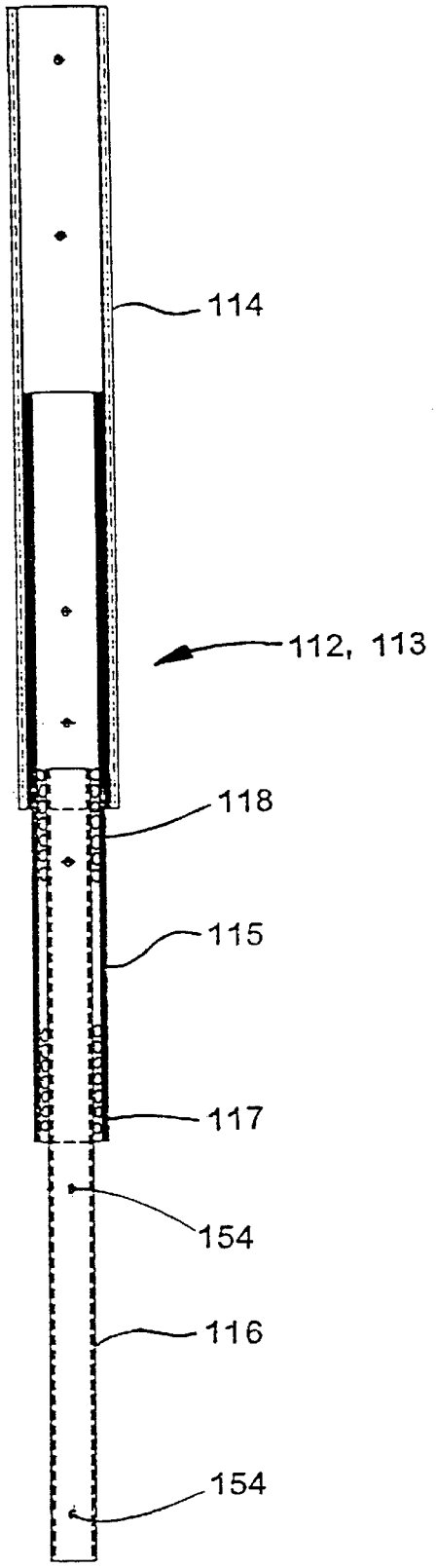
FIG. 23 is a front elevational view of a slide for the leg assembly.
Figure 23A:
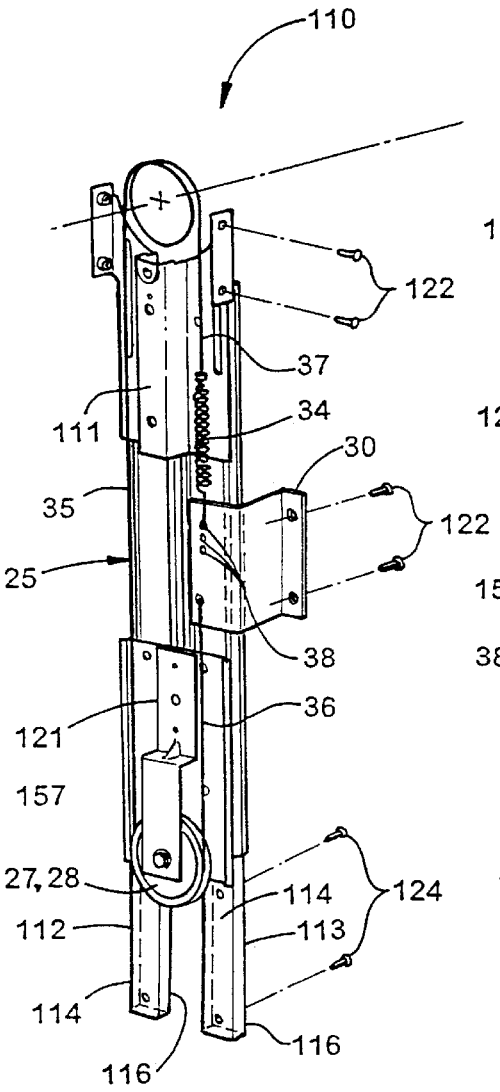
FIG. 23A is a fragmentary, partially schematic perspective view of a first embodiment of the leg assembly.

With reference to FIG. 23A, a first embodiment of the leg assembly includes fasteners 122 that secure bracket 111 to bracket 2 of the counterbalance mechanism 1. Fasteners 123 secure cable attachment bracket 30 to uprights 150 of base 40, and fasteners 124 secure rails 116 of slides 112, 113 to base 40. Bracket 30 is connected to rail 116 to support the leg assembly. As discussed above, portions 35 and 36 of cable 25 are normally in tension to provide a lifting force for the worksurface, and upper cable portion 37 is relatively slack. A spring 34 connects slack upper cable portion 37 to bracket 30 to compensate for variations in cable length and other dimensional variations in the components. Spring 34 also facilitates cable assembly. A plurality of adjustment holes 38 in bracket 30 permit adjustment of the spring mounting location and tension to permit additional adjustment to account for dimensional variations in the components of the leg assembly.

Figure 23B:
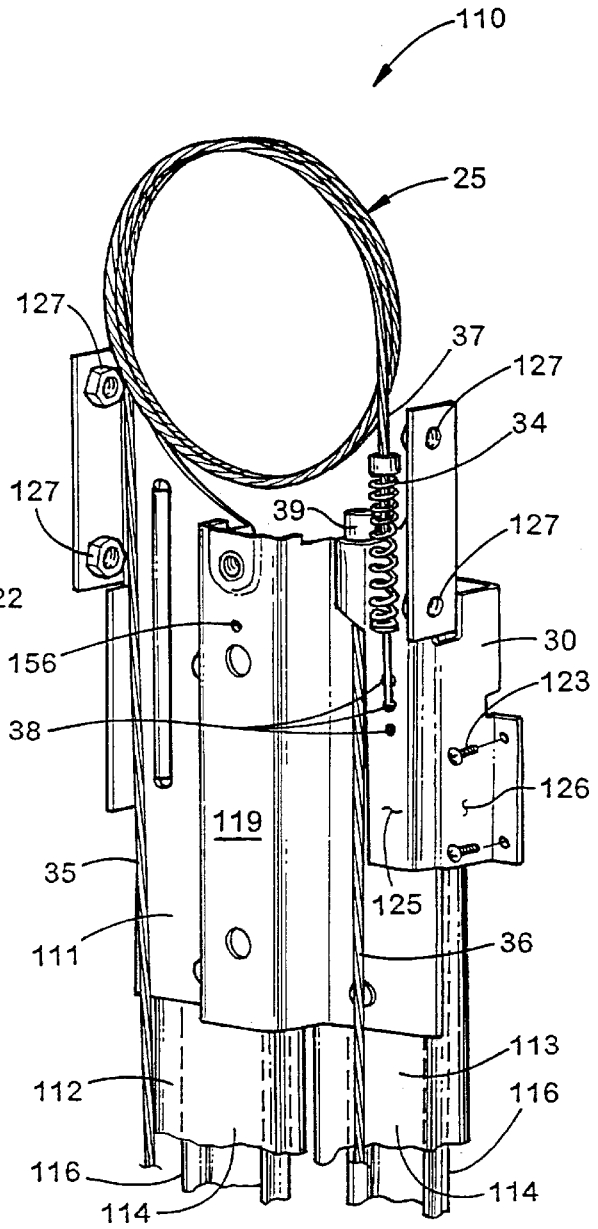
FIG. 23B is a fragmentary, partially schematic perspective view of the upper portion of another embodiment of the leg assembly.

With further reference to FIG. 23B, in a second embodiment, bracket 30 is secured to uprights 150 of base 40 by fasteners 123 in a manner similar to that described above. End fitting 39 secures tension cable portion 36 to bracket 30. A plurality of openings 38 provide adjustable attachment of spring 34 to bracket 30 to adjust the tension of spring 34. Bracket 30 has an L-shaped cross-sectional portion formed by webs 125 and 126. The L-shaped cross section provides clearance for bracket 111 when the worksurface is in the lower position illustrated in FIG. 23B.

Figure 22:
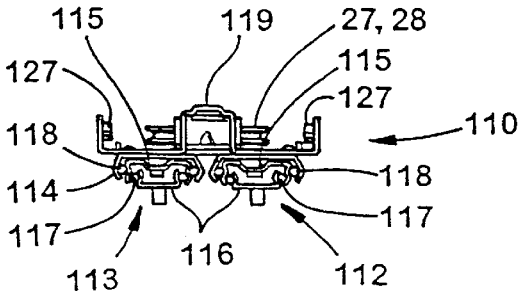
FIG. 22 is a top plan view of the leg assembly.
Figure 22A:
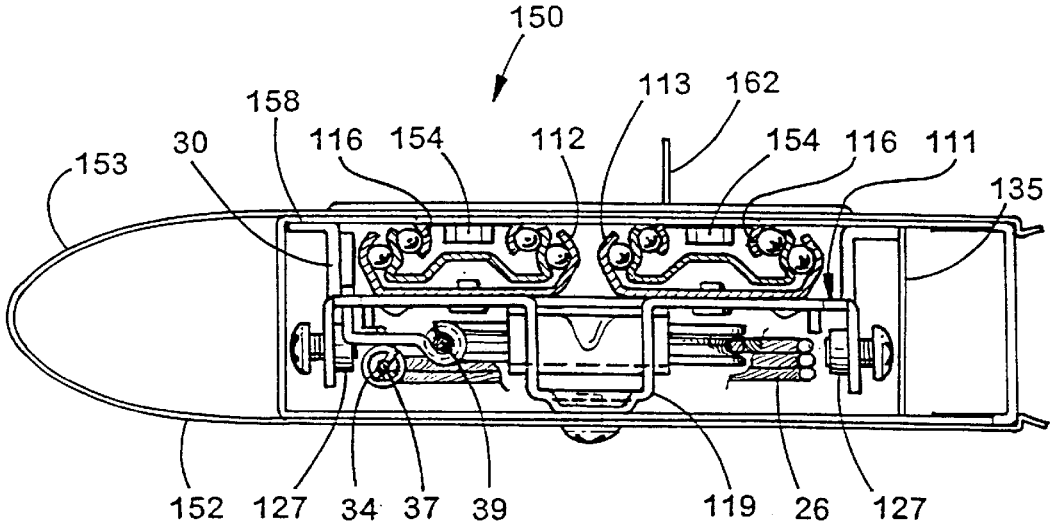
FIG. 22A is a cross-sectional view taken along the line XXIIA—XXIIA, of FIG. 1.

With reference to FIG. 1, base 40 includes a pair of uprights 150, each having an elongated foot portion 151 for stability. Cross-members 160 and 161 rigidly interconnect uprights 150. With further reference to FIG. 22A, each upright 150 includes a sheet metal skin 152 with a curved forward portion 153. Skin 152 has sufficient thickness to form a rigid structure for attachment of slides 112, 113. Fasteners 154 secure rails 116 (not shown) to skin 152 of upright 150. A fastener secures the upper end of U-shaped cover 155 to opening 156 (see also FIG. 23B) of bracket 111, and a tab (not shown) secures the lower end of cover 155 to slot 157 in lower bracket 121 (see also FIG. 21). A fastener (not shown) secures bracket 30 to skin 152 at 158. Cover 155 encloses the cables and telescopes within uprights 150. Bracket 162 connects upright 150 to cross piece 160. The left-hand upright is a mirror image of the right-hand upright illustrated in FIG. 22A, and described above.

Figure 24:
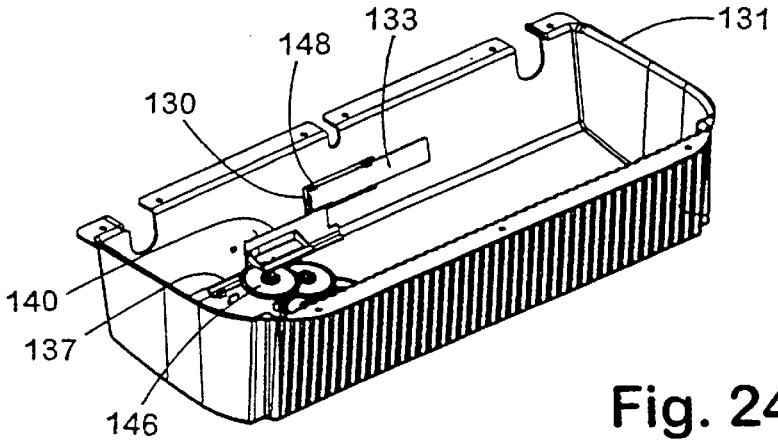
FIG. 24 is a perspective view of a cover, showing an indicator assembly.
Figure 26:
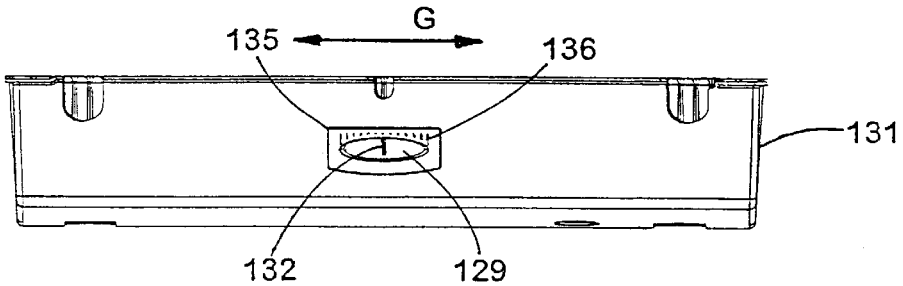
FIG. 26 is a front elevational view of the cover and indicator assembly.
Figure 27:
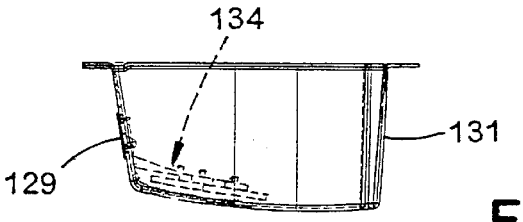
FIG. 27 is side elevational view of the cover and indicator assembly.

As illustrated in FIG. 24, indicator assembly 130 is mounted in cover 131. An indicator plate 133 includes indicia such as a line 132 that is visible through an aperture 129 in cover 131 (FIG. 26). The plate 133 is operably connected to the preload adjustment knob 83 and indicator gear 90 by a gear assembly 138. Rotation of the preload knob 83 causes a corresponding rotation of the indicator gear 90, causing the plate 133 to translate horizontally as indicated by the arrow "G." A faceplate 135 is mounted to the cover 131, and includes indicia 136 on the face such that the position of the line 132 provides a visual reading to the user of the preload of the counterbalance mechanism. In the illustrated example, when the line 132 is to the left-most position, a "zero-lbs." counterbalance force or preload condition is indicated. When the line 132 is in the right-most position, a "100 lb." counterbalance force or preload condition is indicated. The indicated preload corresponds to the amount of weight that may be placed on the worksurface 3 to provide a neutral balance wherein the counterbalance force is equal to the external force on the worksurface. A user can readily set the counterbalance mechanism 1 at the desired counterbalance force level by manually turning the knob 83 until the desired level of preload is indicated.

Figure 25:
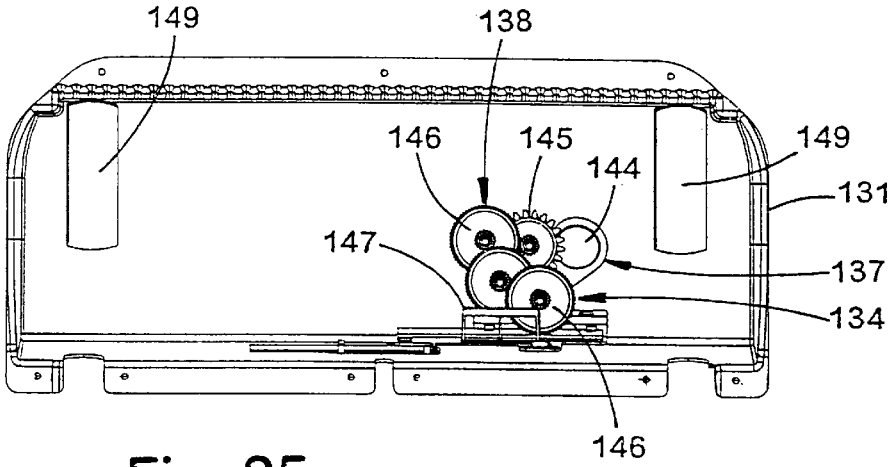
FIG. 25 is a top plan view of the cover and indicator assembly.
Figure 28:
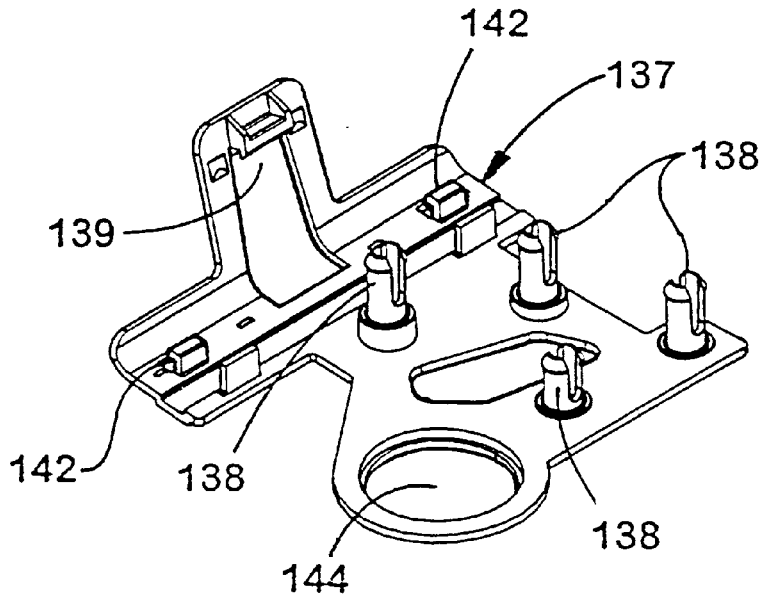
FIG. 28 is a perspective view of a gear support for the indicator assembly.
Figure 29:
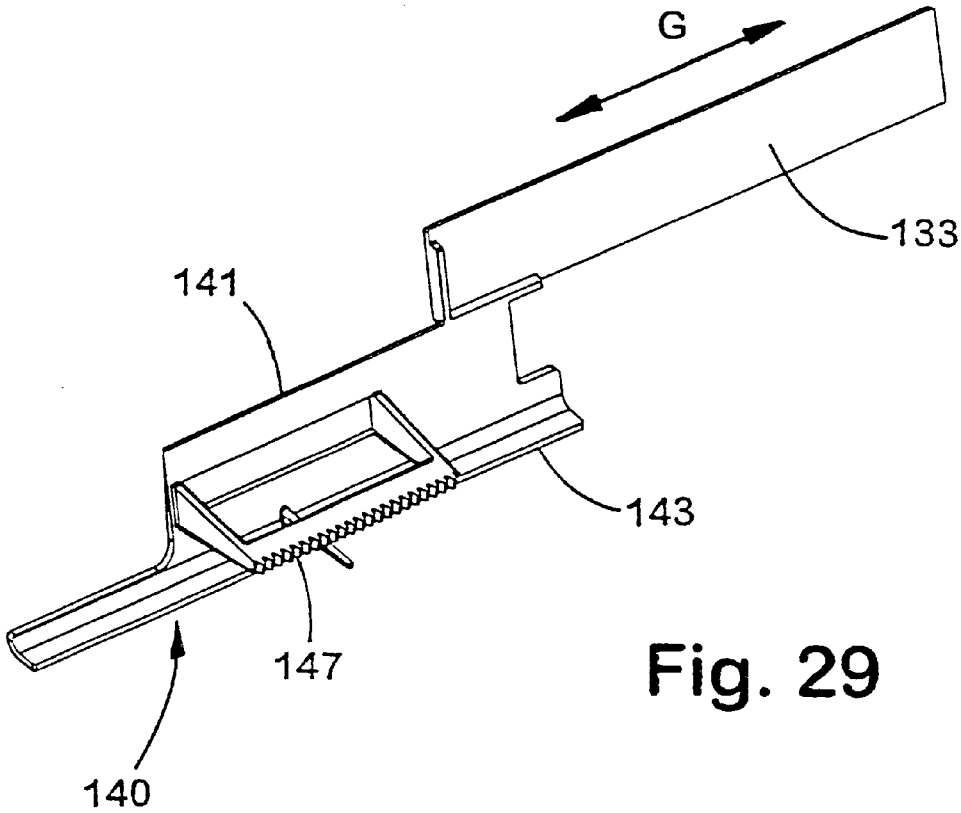
FIG. 29 is a perspective view of a rack member for the indicator assembly.

A gear support 137 (FIG. 28) is made from a suitable polymer material, and includes four barbed posts 138 that rotationally support and retain a gear assembly 134. The gear support 137 includes an upper U-shaped guide 139 and a pair of U-shaped lower guides 142 that slidably support the rack member 140 (FIG. 29) along an upper edge 141 and a lower edge 143 thereof. The worm gear shaft 85 of the preload gear mechanism 8 is received in an opening 144 (FIG. 28) of gear support 137 such that the indicator gear 90 meshes with a first gear 145 (FIG. 25). Three gears 146 interconnect, and mesh with a rack 147, such that the rack member 140 translates horizontally upon rotation of the worm gear input shaft 85 and indicator gear 90 of the preload mechanism 8. The plate portion 133 of the rack member 140 is slidably supported by a guide portion 148 (FIG. 24) of the cover 131. Legs 32 and 33 fit through openings 149 (FIG. 25) when the cover 131 is in the installed position.

During operation of the adjustable height support, a user manually turns the preload adjustment knob 83, changing the deflection and resultant torque of spring 5, until a counterbalance force corresponding to an external weight acting on the worksurface 3 is achieved. The user can determine what the counterbalance force is by observation of the position of the indicator line 132 during adjustment of the counterbalance force. The release lever 68 may then be actuated, causing the brake mechanism 45 to release. While holding the release lever 68 in the actuated position, the user grasps the worksurface 3 and manually adjusts the height by moving the worksurface 3 upwardly or downwardly. In the event the counterbalance force of the counterbalance mechanism 1 is different than the external force acting downwardly on the worksurface 3, the counterbalance force on the counterforce mechanism 1 is adjusted by rotating knob 83 and varying the preload torque of the first spring 5 until the proper setting is achieved. For height adjustment of the embodiment of the worksurface 3 that utilizes the manual gearbox 100, a crank handle (not shown) is grasped and manually rotated, causing the input shaft 101 and worm gear 102 to rotate. The helical gear 103, shaft 105, and drive shaft 4 also rotate, thereby directly adjusting the height of worksurface 3.

As discussed above, the height of the worksurface 3 cannot be adjusted when the counterbalance force of the counterbalance mechanism 1 is not equal to the weight on worksurface 3, or within the allowable range of imbalance. Actuation of release lever 68 when an unbalanced condition exists, will not actuate release mechanism 60, and the brake mechanism 45 will remain in the braked position such that the worksurface 3 cannot be moved by the user. As discussed above, this feature of the release mechanism 60 prevents unexpected and/or sudden upward or downward movement of the worksurface 3 which would otherwise result if the brake mechanism 45 were released when the preload on the counterbalance mechanism 1 was too high or too low.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A counterbalance mechanism for vertically adjustable worksurfaces and the like, comprising:

a support adapted to mount said counterbalance mechanism adjacent an associated worksurface;

a drive shaft mounted on said support for axial rotation, and adapted for operable connection with the worksurface to facilitate vertical adjustment of the same within a predetermined range;

a first energy storage device operably connected between said support and said drive shaft, and applying a first axial torque to said drive shaft in a first rotational direction; said first energy storage device being configured such that said first axial torque diminishes at a predetermined rate as said drive shaft rotates in said first rotational direction; and a second energy storage device operably connected between said support and said drive shaft, and applying a second axial torque to said drive shaft in a second rotational direction opposite to said first rotational direction, thereby defining a resultant counterbalance force which facilitates vertical adjustment of the worksurface; said second energy storage device being configured such that when said drive shaft rotates in said first rotational direction, said second axial torque diminishes at a rate which is substantially equal to said predetermined rate of said first energy storage device, whereby said resultant counterbalance force remains generally constant throughout said predetermined range of vertical adjustment of the worksurface.

2. A counterbalance mechanism as set forth in claim 1, wherein:

said first energy storage device comprises a first spring, and said second energy storage device comprises a second spring.

3. A counterbalance mechanism as set forth in claim 2, including:

a cam operably connecting said second spring with said drive shaft.

4. A counterbalance mechanism as set forth in claim 3, wherein:

said first spring comprises a torsional coil spring disposed coaxially with said drive shaft, having a first end thereof fixedly connected to said support, and a second end thereof fixedly connected to said drive shaft.

5. A counterbalance mechanism as set forth in claim 4, wherein:

said second spring includes a compensator shaft rotatably mounted to said support; and including:

a flexible line wound around a portion of said compensator shaft and a portion of said cam thereby operably interconnecting said drive shaft and said compensator shaft; and wherein said second spring comprises a torsional coil spring having one end portion thereof fixed to said base and a second end portion thereof fixed to said compensator shaft.

6. A counterbalance mechanism as set forth in claim 5, including:

a rotationally adjustable mount, connected with said support, and selectively varying the rotational position of the first end of said first spring to adjust the magnitude of said first axial torque.

7. A counterbalance mechanism as set forth in claim 6, including:

a brake movable between an engaged position wherein said drive shaft is rotationally locked to said support, and a released position wherein said drive shaft is free to rotate.

8. A counterbalance mechanism as set forth in claim 7, including:

a release that permits movement of said brake to said released position when the difference between said counterbalance force and a selected weight on the worksurface is within a preselected range.

9. A counterbalance mechanism as set forth in claim 1, wherein:

an external torque acts on said drive shaft in a direction opposite said first axial torque; and including:

an indicator communicating a signal to a user when an imbalance condition exists due to said counterbalance force being unequal to said external torque.

10. A counterforce mechanism for adjustable furniture and the like, comprising:

a support adapted to mount said counterforce mechanism in an associated furniture article;

a drive shaft mounted on said support for axial rotation, and adapted for operable connection with the furniture article to facilitate adjustment of the same;

a first energy storage device operably connected between said support and said drive shaft, and applying a first axial torque to said drive shaft in a first rotational direction;

an eccentric mounted on said drive shaft, and rotating therewith; and a second energy storage device operably connected between said support and said eccentric, and applying a second axial torque to said drive shaft in a second rotational direction opposite to said first rotational direction, thereby defining a resultant counterbalance force which facilitates adjustment of the furniture article.

11. A counterforce mechanism as set forth in claim 10, wherein:

said first energy storage device comprises a first spring, and said second energy storage device comprises a second spring.

12. A counterforce mechanism as set forth in claim 11, wherein:

said eccentric comprises a cam having a marginal cam surface; and including:

a flexible member having one end portion thereof wound around at least a portion of said marginal cam surface, and an opposite end portion thereof connected with said second spring.

13. A counterforce mechanism as set forth in claim 12, including:

a movable spring mount connecting said first spring with said support, and being configured to selectively deflect said first spring to provide adjustment of said first axial torque.

14. A counterforce mechanism as set forth in claim 13, wherein:

said first spring comprises a torsional coil spring, and said second spring comprises a torsional coil spring; and including:

a compensator shaft rotatably mounted to said support, wherein one end of said second spring is fixed to said support, and the opposite end of said second spring is fixed to said compensator shaft.

15. A counterforce mechanism as set forth in claim 14, including:

a brake mounted to said support, and being movable between an engaged position wherein said drive shaft is rotationally locked to said support, and a released position wherein said drive shaft is free to rotate.

16. A counterforce mechanism as set forth in claim 15, including:

a release that permits movement of said brake to said released position when the difference between said counterbalance force and a selected weight on the worksurface is within a preselected range.

17. A counterforce mechanism as set forth in claim 10, including:

a movable spring mount connecting said first spring with said support, and being configured to selectively deflect said first spring to provide adjustment of said first axial torque.

18. A counterforce mechanism as set forth in claim 10, including:

a brake mounted to said support, and being movable between an engaged position wherein said drive shaft is rotationally locked to said support, and a released position wherein said drive shaft is free to rotate.

19. A counterforce mechanism as set forth in claim 18, including:

a release that permits movement of said brake to said released position when the difference between said counterbalance force and a selected weight on the worksurface is within a preselected range.

20. A height adjustable support for office equipment and the like, comprising:

a worksurface;

a base shaped to support said worksurface;

a guide operably connecting said worksurface with said base for movement between a raised position and a lowered position;

a drive shaft mounted in said base for axial rotation, and operably connected with said worksurface such that rotation of said drive shaft shifts said worksurface;

a counterbalance mechanism operably connected between said worksurface and said base, and generating a lifting force which biases said worksurface toward said raised position; and a brake mechanism retaining said worksurface in a selected position, and including a brake surface rotating with said drive shaft, a flexible line wrapped about at least a portion of said brake surface, and a brake actuator which shifts between a locked position wherein said flexible line is tensed and frictionally engaging said brake surface and preventing rotation of said drive shaft, and an unlocked position wherein said flexible line is slackened and allows said drive shaft to rotate.

21. A height adjustable support as set forth in claim 20, wherein said counterbalance mechanism includes:

a first energy storage device operably connected between said base and said drive shaft, and applying a first axial torque to said drive shaft in a first rotational direction; said first energy storage device being configured such that said first axial torque diminishes at a predetermined rate as said drive shaft rotates in said first rotational direction; and a second energy storage device operably connected between said base and said drive shaft, and applying a second axial torque to said drive shaft in a second rotational directional direction opposite to said first rotational direction, thereby defining a resultant lifting force which facilitates vertical adjustment of said worksurface, said second energy storage device being configured such that when said drive shaft rotates in said first rotational direction, said second axial torque diminishes at a rate which is substantially equal to the predetermined rate of said first energy storage device, whereby the resultant lifting force remains generally constant.

22. A height adjustable support as set forth in claim 21, wherein:

said first energy storage device comprises a first spring, and said second energy storage device comprises a second spring.

23. A height adjustable support as set forth in claim 22, including:

a cam operably interconnecting said second spring and said drive shaft.

24. A height adjustable support as set forth in claim 23, wherein:

said first spring is a torsional coil spring that is coaxial with said drive shaft, wherein one end of the first spring is rigidly connected to said support, and the opposite end is fixed to said drive shaft.

25. A height adjustable support as set forth in claim 24, including:

a compensator shaft rotatably mounted to said support; and a flexible line that is wound around a portion of said compensator shaft and a portion of the cam to thereby operably connect the drive shaft and the compensator shafts; and wherein:

said second spring comprises a torsional coil spring having one end portion thereof fixed to said support and a second end portion thereof fixed to said compensator shaft.

26. A height adjustable support as set forth in claim 25, including:

a rotationally adjustable mount connected with said support, and selectively varying the rotational position of the first end of said first spring to adjust the magnitude of said first axial torque.

27. A height adjustable support as set forth in claim 26, including:

a brake movable between an engaged position wherein said drive shaft is rotationally locked to said support, and a released position wherein said drive shaft is free to rotate.

28. A height adjustable support as set forth in claim 27, including:

a release that permits movement of said brake to said released position only when said counterbalance force is within a preselected range of a selected weight on the worksurface.

29. A height adjustable support as set forth in claim 21, wherein:

said first axial torque is variable to adjust the magnitude of the counterbalance force.

30. A height adjustable support for computers and the like, comprising:

a worksurface;

a base;

a guide operably interconnecting said worksurface and said base for guided motion between a raised position and a lowered position;

a counterforce mechanism generating a lifting force biasing said worksurface into said raised position; and an indicator operably connected to said counterforce mechanism and providing a signal that communicates the magnitude of said lifting force to a user.

31. A height adjustable support as set forth in claim 30, wherein:

said indicator provides a visual signal corresponding to the magnitude of said lifting force to a user.

32. A height adjustable support as set forth in claim 31, wherein the counterforce mechanism includes:

a support mounting said counterforce mechanism to said worksurface;

a drive shaft mounted on said support for axial rotation, and adapted for operable connection with said worksurface to facilitate vertical adjustment of the same within a predetermined range;

a first energy storage device operably connected between said support and said drive shaft, and applying a first axial torque to said drive shaft in a first rotational direction; said first energy storage device being configured such that said first axial torque diminishes at a predetermined rate as said drive shaft rotates in said first rotational direction; and a second energy storage device operably connected between said support and said drive shaft, and applying a second axial torque to said drive shaft in a second rotational direction opposite to said first rotational direction, thereby defining a resultant lifting force which facilitates vertical adjustment of the worksurface; said second energy storage device being configured such that when said drive shaft rotates in said first rotational direction, said second axial torque diminishes at a rate which is substantially equal to said predetermined rate of said first energy storage device, whereby said resultant lifting force remains generally constant throughout said predetermined range of vertical adjustment of the worksurface.

33. A height adjustable support as set forth in claim 32, wherein: said first energy storage device comprises a first spring, and said second energy storage device comprises a second spring.

34. A height adjustable support as set forth in claim 33, including:

a cam operably connecting said second spring with said drive shaft.

35. A height adjustable support as set forth in claim 34, wherein:

said first spring comprises a torsional coil spring disposed coaxially with said drive shaft, having a first end thereof fixedly connected to said support, and a second end thereof fixedly connected to said drive shaft.

36. A height adjustable support as set forth in claim 35, wherein:

said second spring includes a compensator shaft rotatably mounted to said support; and including:

a flexible line wound around a portion of said compensator shaft and a portion of said cam thereby operably interconnecting said drive shaft and said compensator shafts; and wherein:

said second spring comprises a torsional coil spring having one end portion thereof fixed to said base and a second end portion thereof fixed to said compensator shaft.

37. A height adjustable support as set forth in claim 36, including:

a rotationally adjustable mount, connected with said support, and selectively varying the rotational position of the first end of said first spring to adjust the magnitude of said first axial torque.

38. A height adjustable support as set forth in claim 37, wherein:

said indicator includes a visual readout that moves upon rotation of said adjustable mount.

39. A height adjustable support as set forth in claim 38, including:

a brake movable between an engaged position wherein said drive shaft is rotationally locked to said support, and a released position wherein said drive shaft is free to rotate.

40. A height adjustable support for computer equipment and the like, comprising:

a base;

a worksurface;

a pair of spaced-apart legs extending downwardly from said worksurface and slidingly engaging said base;

first and second lower wheels, each of which is rotatably mounted adjacent a lower end of a selected leg;

an elongated shaft rotatably mounted to said worksurface and extending between said legs; and first and second flexible lines, each having an upper end forming a loop around said shaft above said lower wheels, each of said upper ends including a resilient tension member connecting said upper ends to said base, a lower end of said first line wrapping at least partially around said first lower wheel and a lower end of said second line wrapping at least partially around said second lower wheel, each cable being fixed to said base such that rotation of said shaft tenses a portion of each of said flexible lines and evenly raises each side of said worksurface without tipping or binding.

41. A height adjustable support as set forth in claim 40, including:

a counterforce mechanism, and wherein:

said shaft comprises a drive shaft operably connected to said counterforce mechanism, said counterforce mechanism generating a torque on said drive shaft biasing said worksurface into a raised position.

42. A height adjustable support as set forth in claim 41, including:

a support adapted to mount said counterforce mechanism adjacent said worksurface;

a drive shaft mounted on said support for axial rotation, and adapted for operable connection with said worksurface to facilitate vertical adjustment of the same within a predetermined range;

a first energy storage device operably connected between said support and said drive shaft, and applying a first axial torque to said drive shaft in a first rotational direction; said first energy storage device being configured such that said first axial torque diminishes at a predetermined rate as said drive shaft rotates in said first rotational direction; and a second energy storage device operably connected between said support and said drive shaft, and applying a second axial torque to said drive shaft in a second rotational direction opposite to said first rotational direction, thereby defining a resultant counterbalance force which facilitates vertical adjustment of the worksurface; said second energy storage device being configured such that when said drive shaft rotates in said first rotational direction, said second axial torque diminishes at a rate which is substantially equal to said predetermined rate of said first energy storage device, whereby said resultant counterbalance force remains generally constant throughout said predetermined range of vertical adjustment of the worksurface.

43. A height adjustable support as set forth in claim 42, wherein:

said first energy storage device comprises a first spring; and wherein:

said second energy storage device comprises a second spring.

44. A height adjustable support as set forth in claim 43, including a cam operably connecting said second spring with said drive shaft.

45. A height adjustable support as set forth in claim 44, wherein said first spring comprises a torsional coil spring disposed coaxially with said drive shaft, having a first end thereof fixedly connected to said support, and a second end thereof fixedly connected to said drive shaft.

46. A height adjustable support as set forth in claim 45, including:

a compensator shaft rotatably mounted to said support; and including:

a flexible line wound around a portion of said compensator shaft and a portion of said cam thereby operably interconnecting said drive shaft and said compensator shafts; and wherein:

said second spring comprises a torsional coil spring having one end portion thereof fixed to said base and a second end portion thereof fixed to said compensator shaft.

47. A height adjustable support as set forth in claim 46, including:

a rotationally adjustable mount, connected with said support, and selectively varying the rotational position of the first end of said first spring to adjust the magnitude of said first axial torque.

48. A height adjustable support as set forth in claim 47, including:

an indicator operably connected to said counterforce mechanism, said indicator communicating the magnitude of said lifting force to a user.

49. A height adjustable support as set forth in claim 40, including:

a manual hand crank operably connected to said shaft such that rotation of said hand crank by a user rotates said shaft and selectively raises or lowers said worksurface.

* * * * *